US006223480B1

(12) United States Patent
Khoo

(10) Patent No.: US 6,223,480 B1
(45) **Date of Patent: *May 1, 2001**

(54) PRE-CAST CONCRETE PANELS FOR CONSTRUCTION OF A BUILDING

(75) Inventor: Tian Khoo, Taman Desa (MY)

(73) Assignee: O-Stable Panel Sdn Bhd, Kuala Lumpur (MY)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/011,420

(22) PCT Filed: Sep. 7, 1996

(86) PCT No.: PCT/SG96/00012

§ 371 Date: Apr. 30, 1998

§ 102(e) Date: Apr. 30, 1998

(87) PCT Pub. No.: WO97/11237

PCT Pub. Date: Mar. 27, 1997

(30) Foreign Application Priority Data

Sep. 8, 1995 (MY) ..... PI9502668

(51) Int. Cl.[7] ..... E04B 1/04; E04B 1/16; E04B 2/00; E04B 2/52; E04B 5/17

(52) U.S. Cl. ..... 52/79.9; 52/79.14; 52/236.8; 52/258; 52/259; 52/262; 52/271; 52/284

(58) Field of Search ..... 52/271, 270, 284, 52/604, 605, 396.08, 396.04, 254, 236.3, 236.5, 236.8, 79.4, 79.9, 79.14, 272, 293.2, 608, 250, 258, 259, 262, 320, 322

(56) References Cited

U.S. PATENT DOCUMENTS 963,368 * 7/1910 Hall ..... 52/284 X
1,072,293 * 9/1913 Zeimet ..... 52/284 X
1,726,169 * 8/1929 Winter ..... 52/270

(List continued on next page.)

FOREIGN PATENT DOCUMENTS

3443/51 * 8/1951 (AU) .
27062/67 * 3/1969 (AU) .

(List continued on next page.)

OTHER PUBLICATIONS

Patent Abstracts of Japan, JP, 7–229203, Aug. 1995.*

*Primary Examiner*—Robert Canfield
(74) *Attorney, Agent, or Firm*—Townsend Townsend & Crew LLP

(57) ABSTRACT

A building made substantially of pre-cast components is disclosed. The building comprises of pre-cast concrete walls, floors and columns; the walls and columns being made of pre-cast concrete wall panels; and floors being made of pre-cast concrete slabs. The panels have one of 'L', 'T', cross or 'I' cross-sectional shapes, wherein the 'L', 'T' and cross-shaped panels are joints between 'I' shaped panels and slabs and panels being interlocked together to form an enclosure. At least some of the 'L', 'T' or cross-shaped or 'I' have a door or window opening. 'I' shaped panels are of varying lengths. Columns are reinforced with steel bars and additional concrete.

14 Claims, 37 Drawing Sheets

U.S. PATENT DOCUMENTS

Figure 1A:
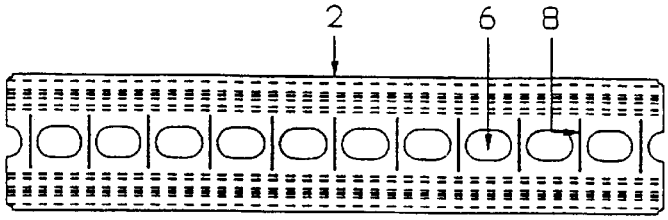

| | | | | |
|---|---|---|---|---|
| 1,924,801 | * | 8/1933 | Olmstead | 52/284 X |
| 1,982,217 | * | 11/1934 | Luehrs . | |
| 2,043,697 | * | 6/1936 | Deichmann . | |
| 2,218,694 | * | 10/1940 | Egoroff . | |
| 2,708,359 | * | 5/1955 | Henry | 52/396.08 |
| 3,035,375 | * | 5/1962 | Williams | 52/396.08 X |
| 3,535,841 | * | 10/1970 | Lorenz et al. | 52/270 X |
| 3,604,169 | * | 9/1971 | Smith | 52/396.04 |
| 3,645,056 | * | 2/1972 | Gerola . | |
| 3,662,506 | * | 5/1972 | Dillon . | |
| 3,685,241 | * | 8/1972 | Cooper | 52/270 |
| 3,759,002 | * | 9/1973 | Cornella et al. | 52/270 |
| 3,821,869 | * | 7/1974 | Morgan . | |
| 3,910,000 | * | 10/1975 | Kelsey . | |
| 3,919,820 | * | 11/1975 | Green | 52/396.04 |
| 3,952,471 | * | 4/1976 | Mooney | 52/284 X |
| 4,147,009 | * | 4/1979 | Watry . | |
| 4,398,378 | * | 8/1983 | Heitzman . | |
| 4,925,556 | * | 5/1990 | Gaudin et al. . | |
| 4,942,707 | * | 7/1990 | Huettemann . | |
| 5,489,164 | * | 2/1996 | Tusch et al. . | |
| 5,548,937 | * | 8/1996 | Shimonohara . | |
| 5,758,461 | * | 6/1998 | McManus | 52/271 X |
| 5,761,862 | * | 6/1998 | Hendershot et al. | 52/284 X |

FOREIGN PATENT DOCUMENTS

| | | | |
|---|---|---|---|
| 447543 | * | 3/1968 | (CH) . |
| 2430635 | * | 1/1976 | (DE) . |
| 2728911 | * | 2/1978 | (DE) . |
| 80980 | * | 6/1983 | (EP) . |
| 938349 | * | 9/1948 | (FR) . |
| 1006076 | * | 4/1952 | (FR) . |
| 2441127 | * | 7/1980 | (FR) . |
| 4267923 | * | 4/1981 | (FR) . |
| 2495207 | * | 6/1982 | (FR) . |
| 650634 | * | 2/1951 | (GB) . |
| 1402259 | * | 8/1975 | (GB) . |
| 94/17259 | * | 8/1994 | (WO) . |

* cited by examiner (SECTION A-A)

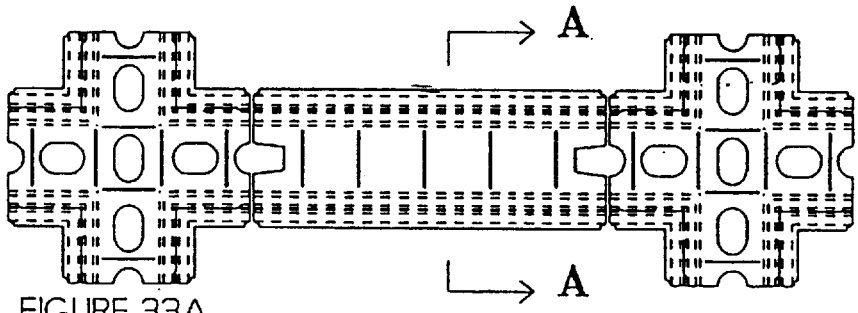
FIGURE 33A
PLAN
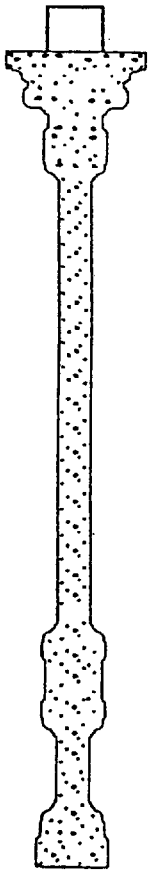
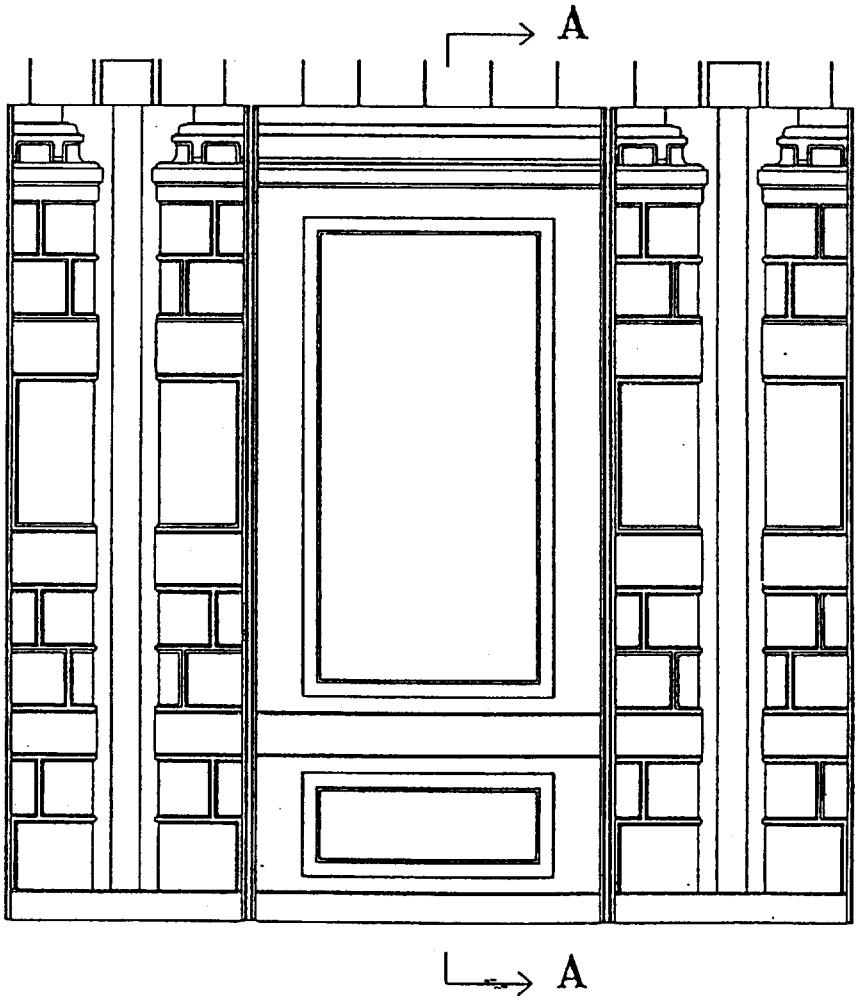
SECTION A-A
FIGURE 33C
ELEVATION
FIGURE 33B

PRE-CAST CONCRETE PANELS FOR CONSTRUCTION OF A BUILDING

The invention relates to set of pre-cast concrete panels for construction of a building and a method of using the same in the building industry.

In building construction, it is often necessary to construct the structural frame work, floor slab and followed by the erection of in-fill panels (normally they are brick walls). Thereafter additional construction work has to be done in the installation of electrical wires, gas and water plumbing connections and external wall furnishing of the building has to be completed. All these require skilled workers and are time consuming and is expensive. The mould formwork set for pre-cast concrete industries in prior art is expensive because a specific mould only can be used for a particular project.

The objectives of this invention are to mitigate these disadvantages by the use of various types of pre-cast concrete panels, adoption of a universal mould formwork set and the adoption of a new system of construction of a building using the pre-cast concrete panels.

According to the first aspect of the invention, the pre-cast concrete wall panels comprise of:

1. 'I' shape panels (straight line in cross-section width wise) and 'I' shape panels with door or window opening,
2. 'L' shape panels and 'L' shape panels with door or window opening,
3. 'T' shape panels and 'T' shape panels with door or window opening,
4. 'Cross' shape cross-sectional panels and 'Cross' shape cross-sectional panels with door or window opening on one or more sides.

According to a second aspect of the invention, the pre-cast concrete wall panels, include a pre-cast concrete beam and a pre-cast concrete cornice finishing at one edge.

According to a third aspect of the invention, a plurality of steel links extend from the pre-cast concrete beam of the pre-cast concrete panels. An interlocking system of reinforced concrete beams if formed by the insertion of reinforcement steel bars through the links and the pouring in-situ concrete to construction joints formed by pre-cast concrete slabs and pre-cast concrete beams of the pre-cast concrete wall panels.

According to a fourth aspect of the invention, the length of 'I' shape pre-cast concrete wall panel can be adjusted at the construction stage to comply with the architectural and engineering requirements by adjusting the edge formwork of moulding formwork set. The arms of 'L' shape, 'T' shape and 'Cross' shape panels can also be adjusted if necessary, but normally they are constant in single size.

According to a fifth aspect of the invention, the pre-cast concrete slab includes recesses at the central region of the slab panel and pre-cast concrete beams along the perimeter of the slab panel.

According to a sixth aspect of the invention, the sizes of the pre-cast concrete slab panels can be adjusted at the casting stage to comply the architectural and structural requirements.

According to seventh aspect of the invention, the height of the pre-cast beam of the pre-cast concrete slab panel can be adjusted at the casting stage to comply with the structural engineering requirements.

Hollow cores extend longitudinally from one end to the other in the pre-cast wall and in the pre-cast slab panel. The hollow cores are designed to accommodate structural, mechanical and electrical requirement. A reinforced concrete column is formed in a bore by inserting reinforcement steel bars into the hollow core of the pre-cast concrete panel and thereafter in-filled with cast-in-situ concrete.

Walls can be erected and supported by introducing reinforcement steel bars and in-fill cast-in-situ concrete into the cores at both ends of the pre-cast concrete wall panels or by introducing reinforcement steel bars and in-fill cast-in-situ concrete to longitudinal recesses which form core when two pre-cast walls are placed in straight-line alignment to each other.

It would understood that the cores can be provided to 'T' shape, 'L' shape and 'cross' shape pre-cast concrete panels but cores may not be necessary to pre-cast concrete wall panels like 'I' shape (straight in cross section). The 'I' shape pre-cast concrete panel may be provided with longitudinal recesses at the both ends of the panel without any cores in between.

The structural linking of pre-cast concrete wall panels and pre-cast concrete slab panels is carried out by introducing reinforcement steel bars through the links extending from the pre-cast concrete beams of the wall panels, adding wire mesh and top bars to the top surface of pre-cast slab panels and pre-cast beams respectively, then pouring concrete into troughs formed by pre-cast concrete slabs and the pre-cast concrete beams to form construction joints. For single storey building, 'U' shape steel bars are inserted into the cast in-situ concrete columns next to each other from the two linearly aligned adjacent pre-cast concrete wall panels.

In-fill wall panel between comers of pre-cast concrete wall panels or between any two desired points can be obtained by using a single panel or plural number of 'I' shape straight wall panels placed in a linear alignment to each other. The length of any panel can be adjusted at the casting stage by sliding an adapter without altering the moulding formwork set.

The invention will be described in detail by reference to preferred embodiment and system of construction with reference to accompanying drawings in which:

FIG. (1A). Shows a top plan view, FIG. (1B) shows side elevation and FIG. (1C) shows section cut through a core (6) of 'I' shape (straight line in cross section) pre-cast concrete wall panel complete with pre-cast concrete beam (2), pre-cast concrete cornice (4) finishing and steel links. (8)

FIG. (1D) shows a top plan view of a 'I' shape pre-cast concrete wall panel without any longitudinal cores within.

FIGS. (2A) & (2B) shows the plan and side view respectively of the 'I' shape panel as stated in FIGS. (1A), (1B), (1C) & (1D) but with door opening. (10)

FIGS. (3A) & (3B) shows the plan and side view respectively of the 'I' shape panel as stated in FIGS. (1A), (1B), (1C) and (1D) but with window opening. (12)

FIG. (4A) shows a top view plan, FIG. (4B) shows side elevation and FIG. (4C) shows section cut through a core of 'L' shape pre-cast concrete wall panel complete with pre-cast concrete beam (2) and pre-cast concrete cornice (4) finishing.

FIGS. (5A) & (5B) shows the plan and side view respectively of the 'L' shape as stated in FIGS. (4A), (4B) & (4C) but with door opening. (10) on an extended arm.

FIG. (6A) shows a top view plan, FIG. (6B) shows side elevation and FIG. (6C) shows section cut through a core of 'T' shape pre-cast concrete wall panel complete with pre-cast concrete beam (2) and pre-cast concrete cornice (4) finishing.

FIGS. (7A) & (7B) shows the plan and side view respectively of the 'T' shape as stated in FIGS. (6A), (6B) & (6C) but with door opening (10) on an extended arm.

FIGS. (8A) & (8B) shows the a plan and side view respectively of a 'T' shape as stated in FIGS. (6A), (6B) & (6C)but with two door openings (10) on two extended arms.

FIG. (9A) shows a top view plan, FIG. (9B) shows side elevation and FIG. (9C) shows section cut through a core of 'Cross' shape pre-cast concrete wall panel complete with pre-cast concrete beam (2) and pre-cast concrete cornice (4) finishing.

FIG. (10) shows the section of vertical casting moulding formwork set for casting a pair of pre-cast concrete wall panels as above stated.

FIG. (11) shows a perspective cut out view of the vertical casting moulding framework shown in FIG. (10)

FIG. (11A) shows an enlarged section of an extendable adapter between two spaced apart edge panels.

Figure 10:
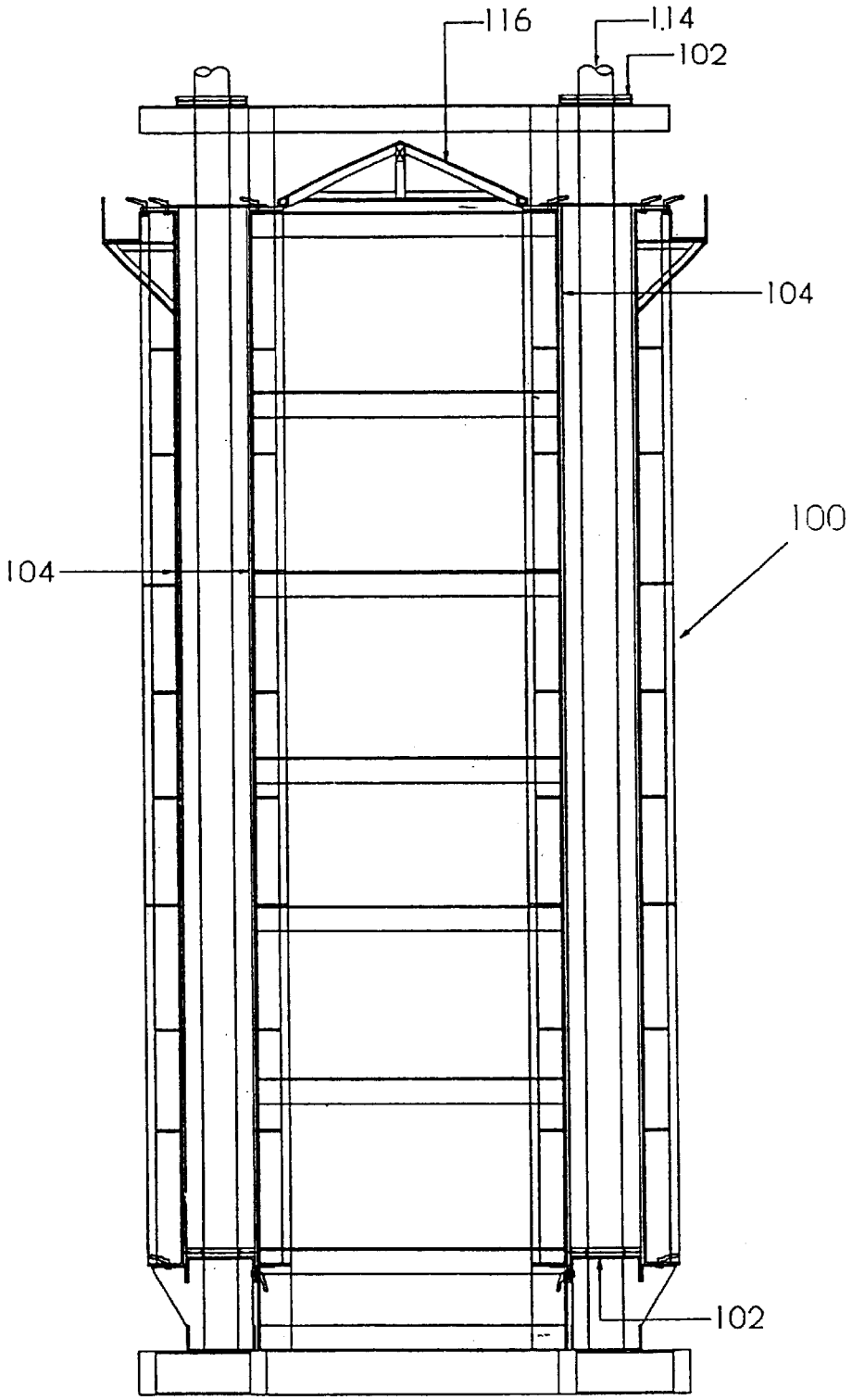

FIG. (11B) shows an adjustable bottom plate for vertical casting moulding framework set. (FIG. 10)

FIGS. (12), (13) & (14) show a cross-sectional view of pre-cast concrete slab panels of varying widths.

FIG. (15A) illustrates the first step in constructing a wall using pre-cast concrete walls whereby a ground floor concrete slab is casted and starter bars are placed at predetermined positions.

Figure 15A:
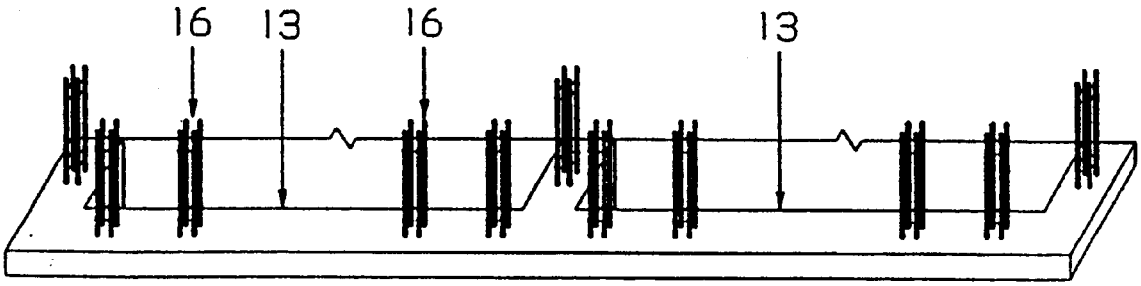
Figure 15B:
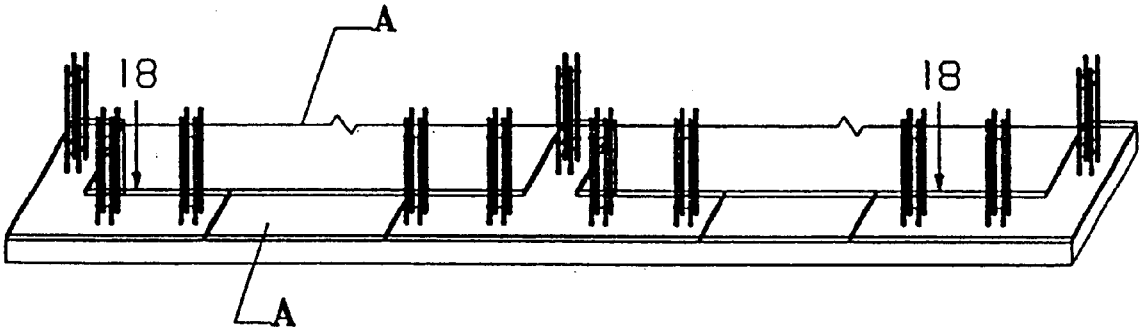
Figure 15C:
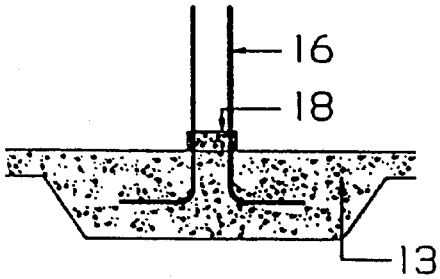

FIG. (15B) illustrates the second step after FIG. 15A whereby concrete kicker is constructed and the level is adjusted to receive the pre-cast concrete wall panels.

FIG. (15C) shows a section A—A cut through FIG. (15B)

Figure 1C:
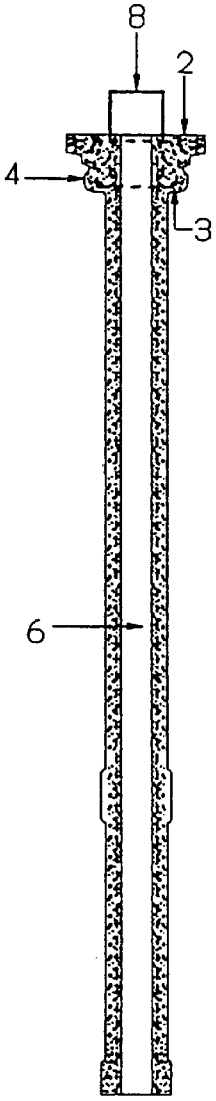
Figure 1B:
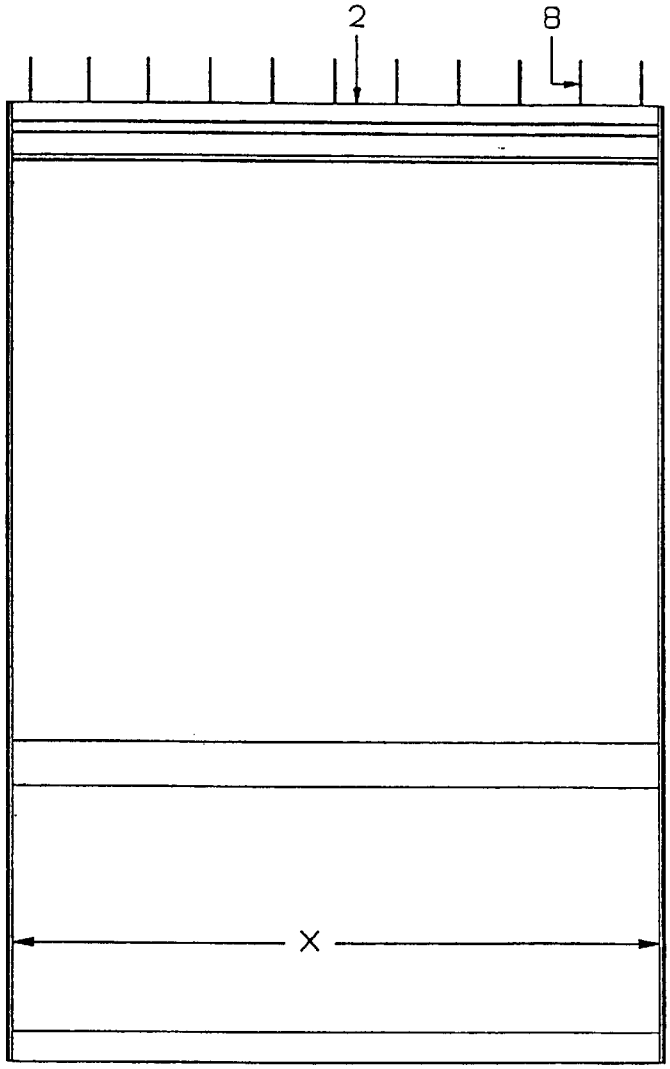
Figure 1D:
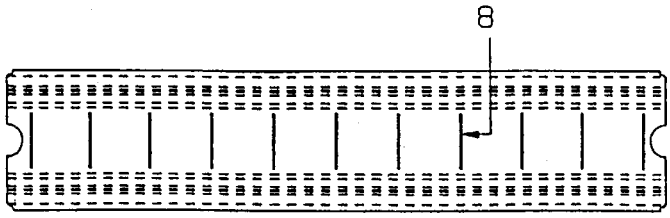

FIG. (16) shows a partially completed building wall where pre-cast concrete wall panels show in FIGS. 1A, 1B, 1C; 4A, 4B, 4C and 6A, 6B, 6C have been erected.

Figure 16:
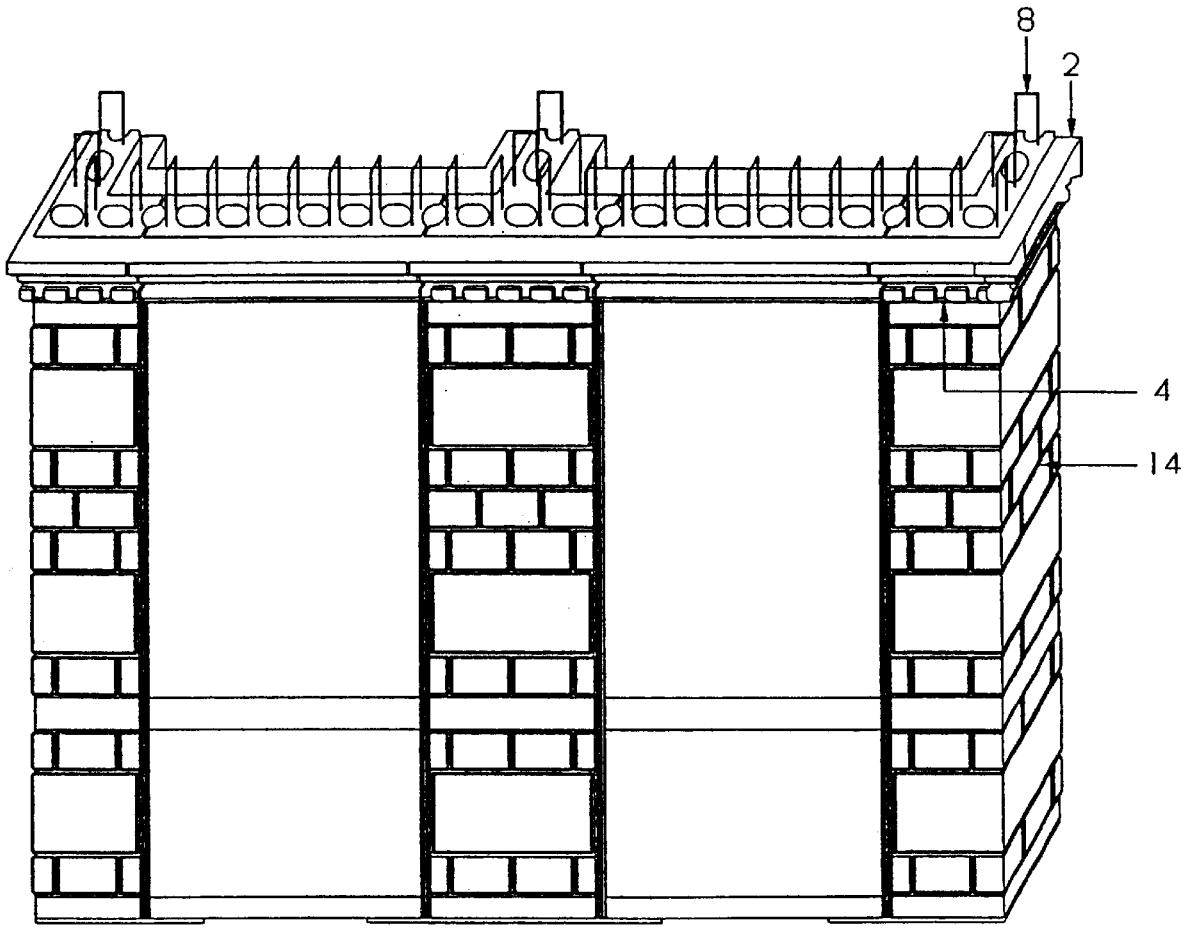
Figure 17A:
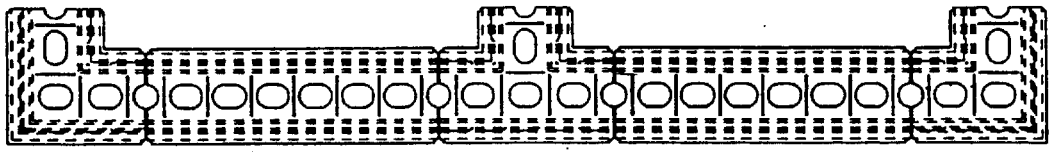
Figure 17B:
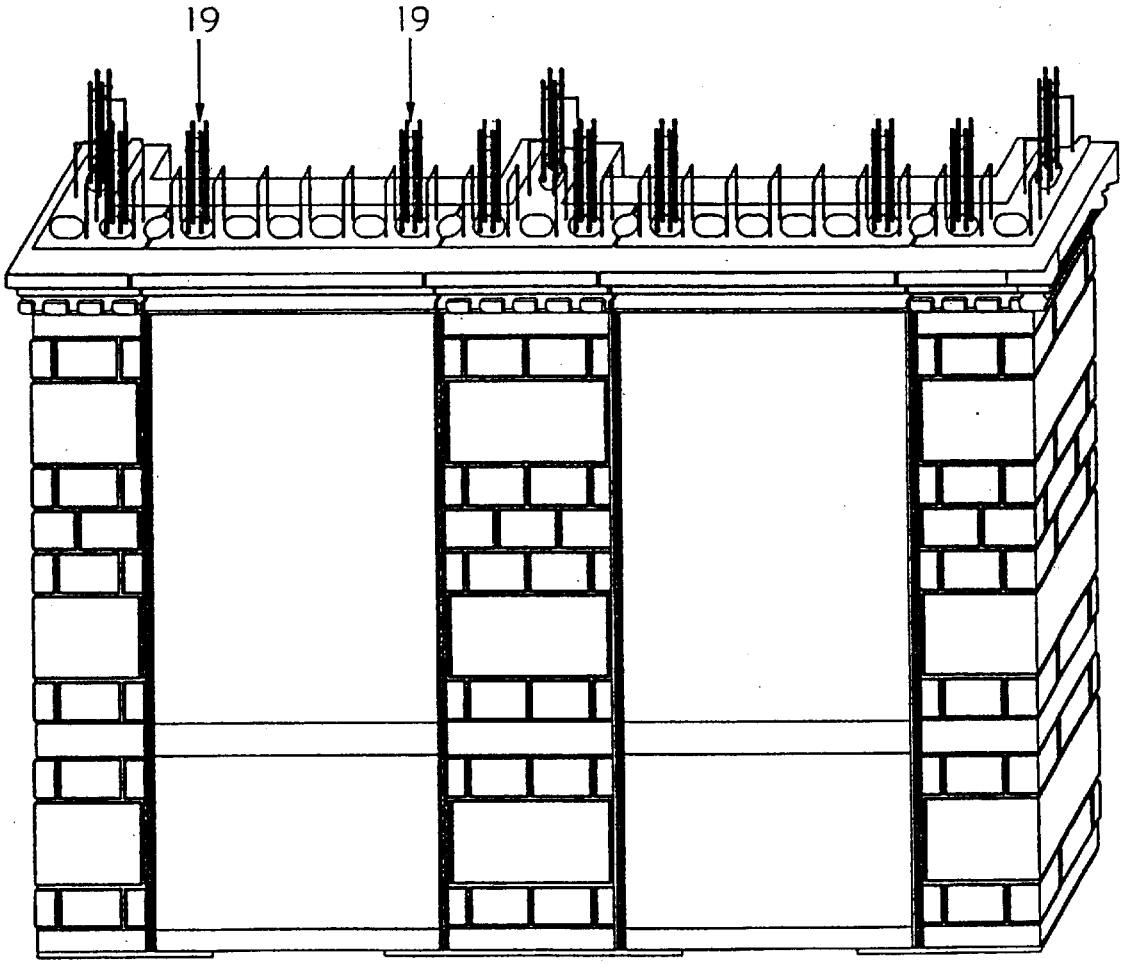
Figure 18:
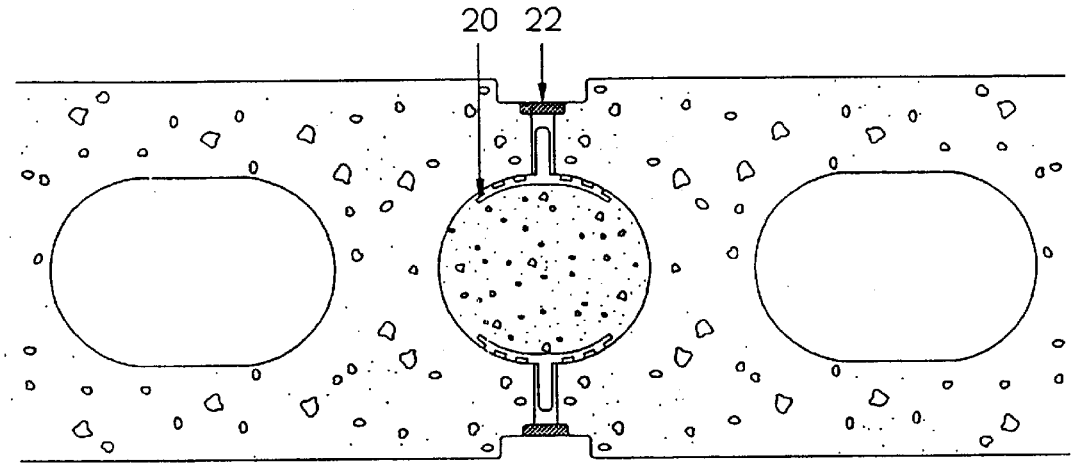
Figures 18A, 18B:
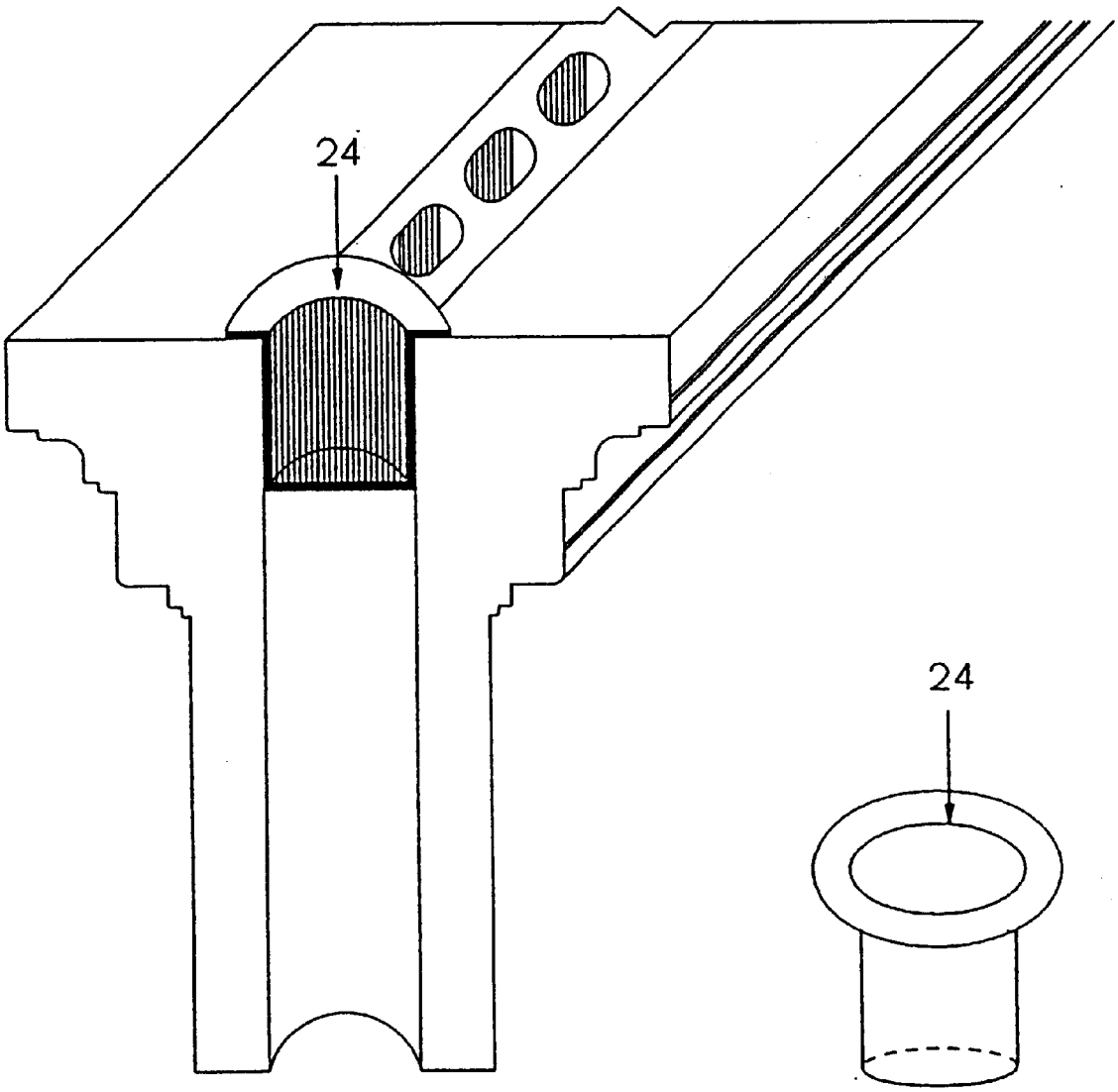
Figure 19:
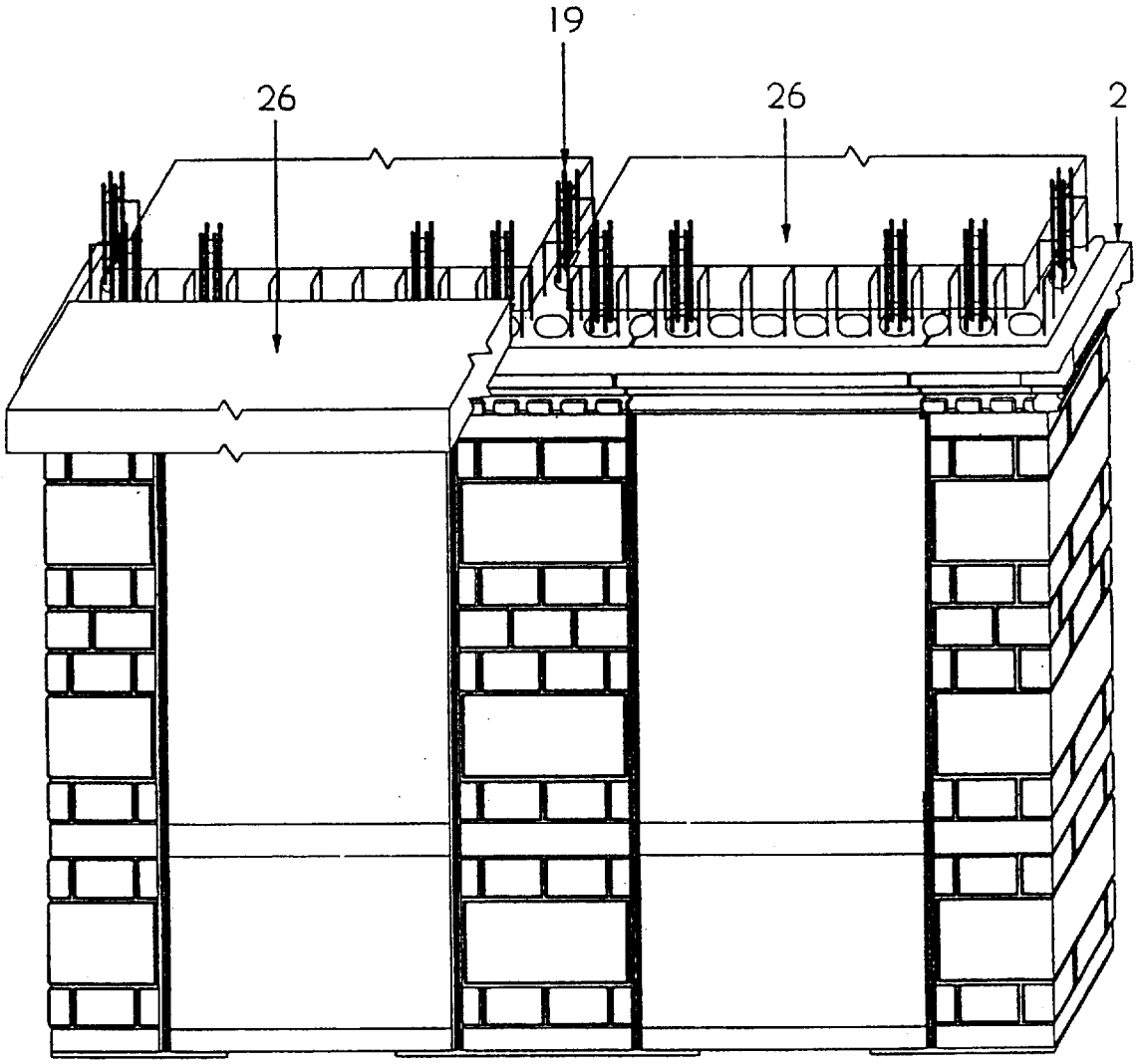
Figure 20:
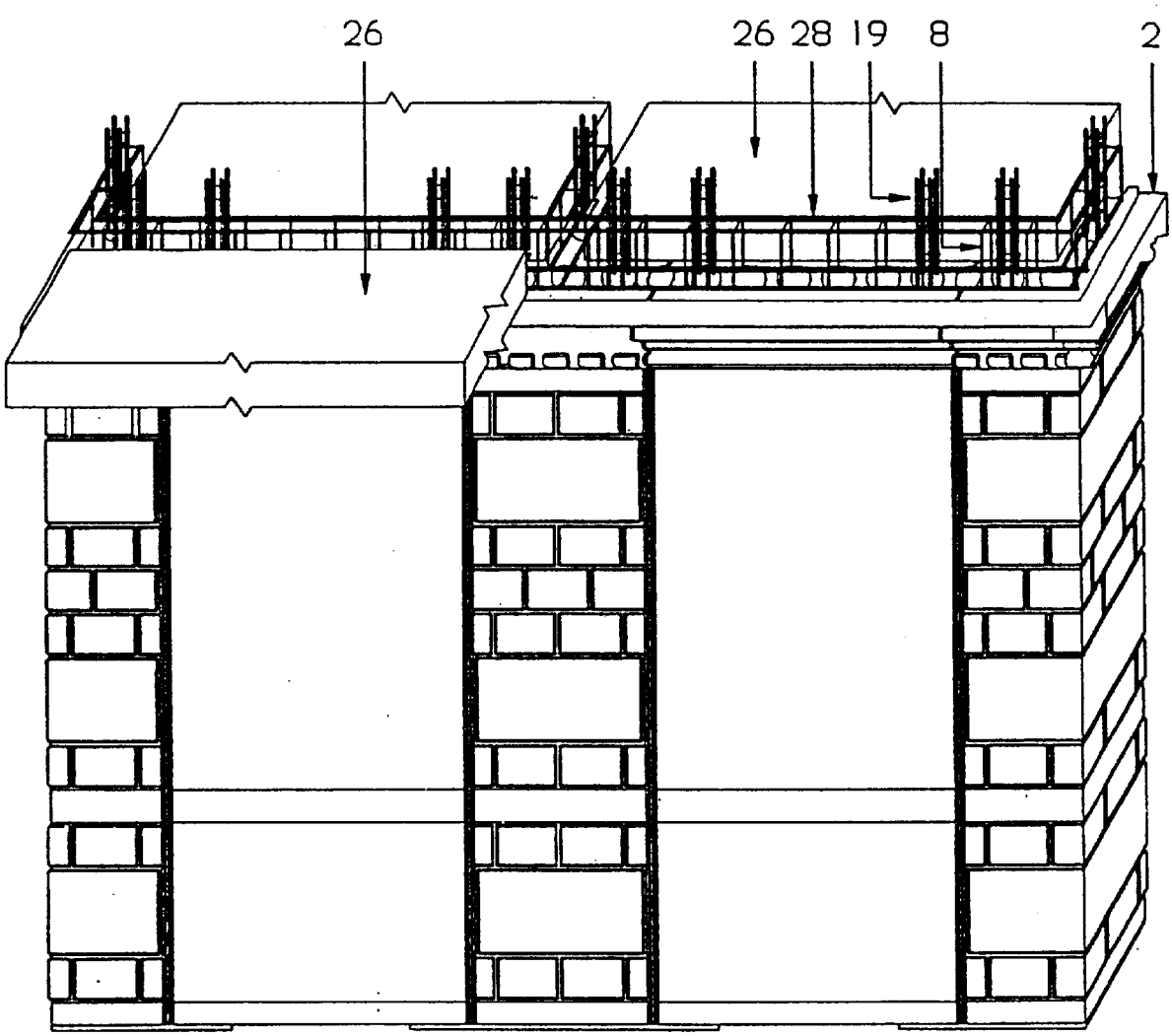
Figure 20A:
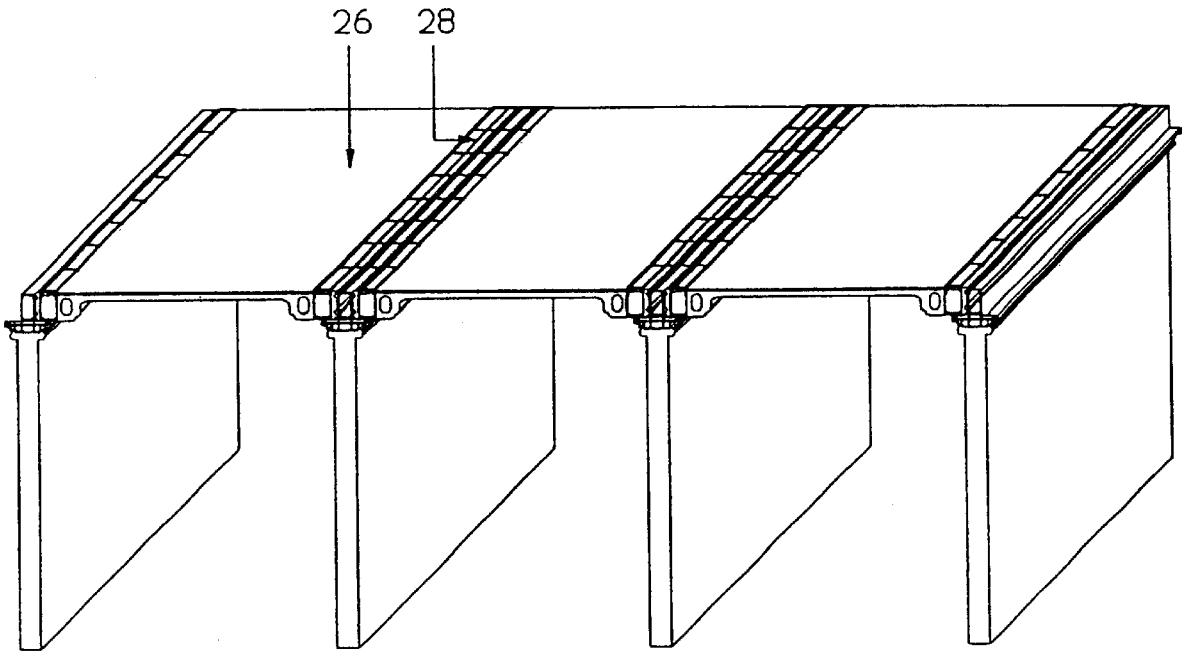

FIG. (17A) shows a top plan view of the partially completed building wall shown in FIG. 16.

FIG. (17B) shows a partially completed building wall with reinforcement steel bars in some of the hollow cores.

FIG. (18) shows a sectional view of the connecting joint between two adjacent pre-cast concrete wall panels.

FIG. (18A) shows a sectional perspective view of a pre-cast concrete wall panel and pre-cast concrete beams with a cap over a hollow core.

FIG. (18B) shows a perspective view of a cap that is designed and configured to be placed over a hollow core.

FIG. (19) shows the positioning of the pre-cast floor slabs on the pre-cast concrete beams of the pre-cast concrete panels.

FIG. (20) shows a perspective view of partially completed building where reinforcement steel bars are introduced through the links extending from the pre-cast concrete beam of pre-cast concrete panels shown in FIG. (19).

FIG. (20A) is a perspective view of an assembly of pre-cast concrete floor slabs positioned over a plurality of pre-cast concrete wall panels.

FIG. (21A) is a sectional view showing in detail the positioning two adjacent pre-cast concrete floor slabs.

FIG. (21B) shows two numbers of pre-cast concrete slab panels laid on the pre-cast concrete beams of a pre-cast concrete wall panel.

FIG. (22) shows a perspective view of the assembly of wire mesh and top bars on the pre-cast concrete floor slab before pouring the concrete.

Figure 22:
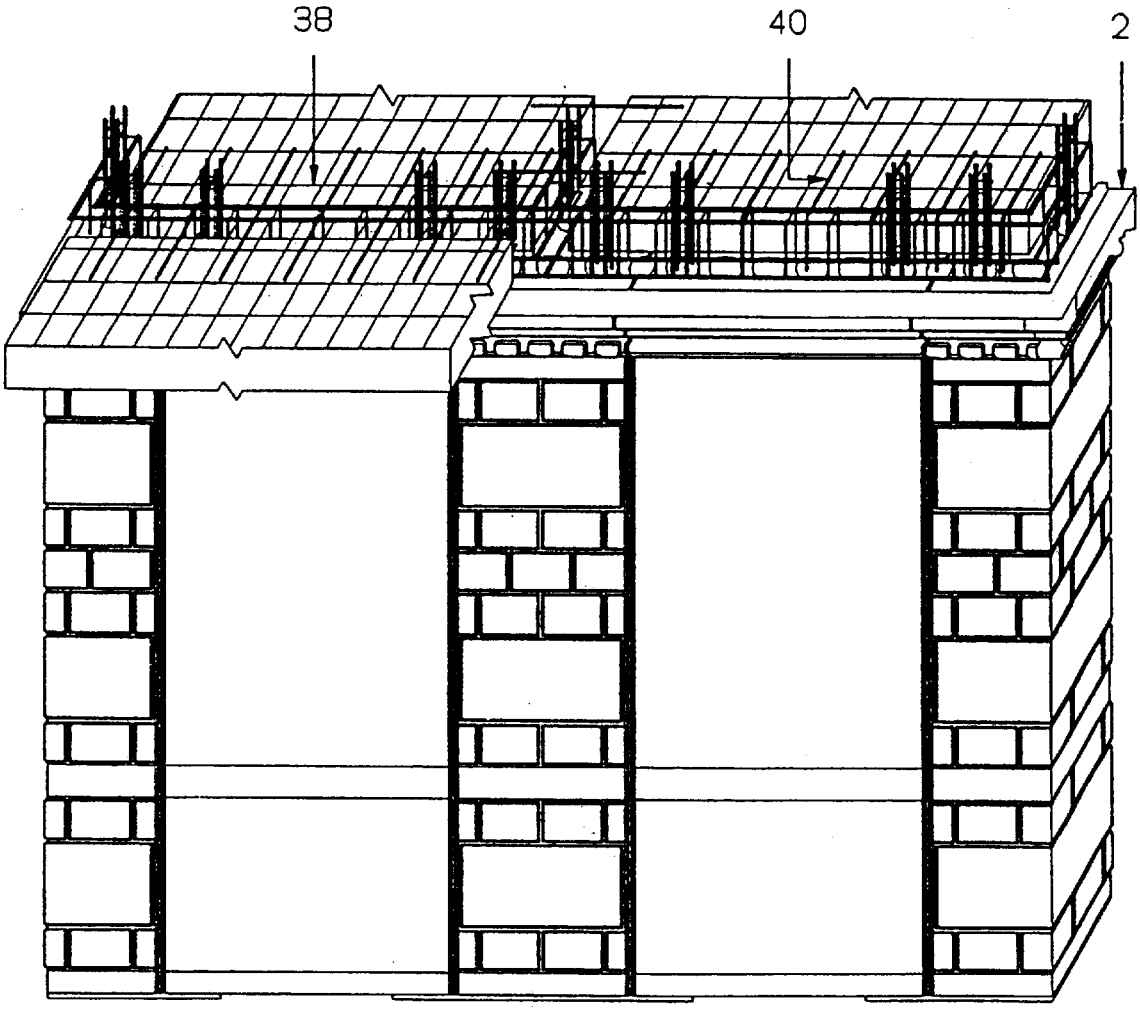
Figure 22A:
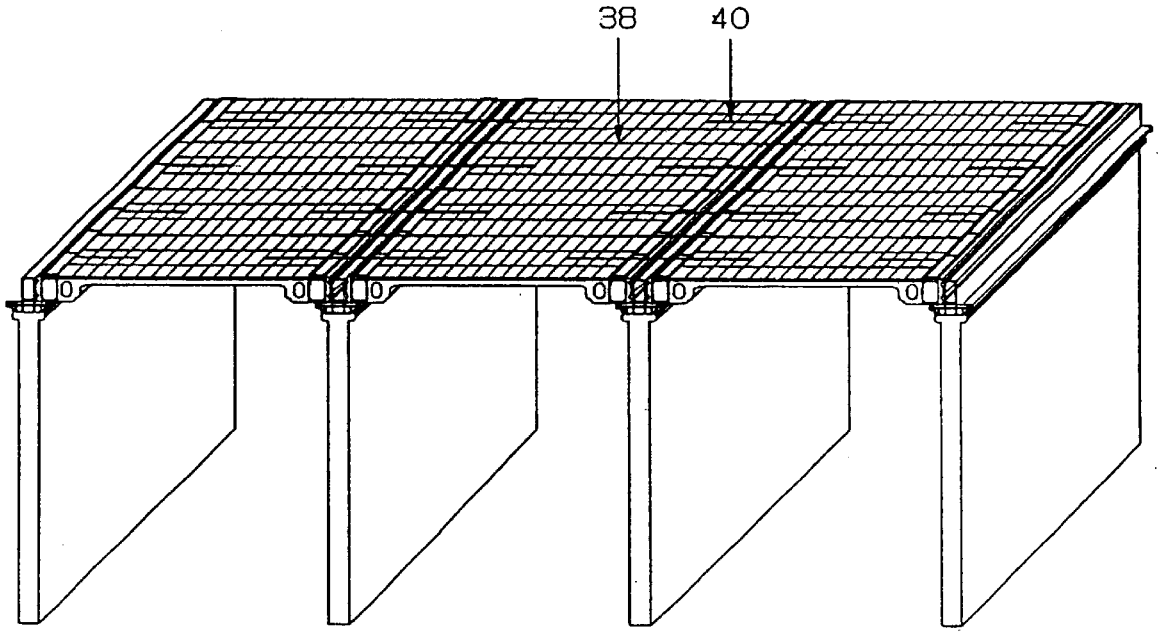
Figure 23:
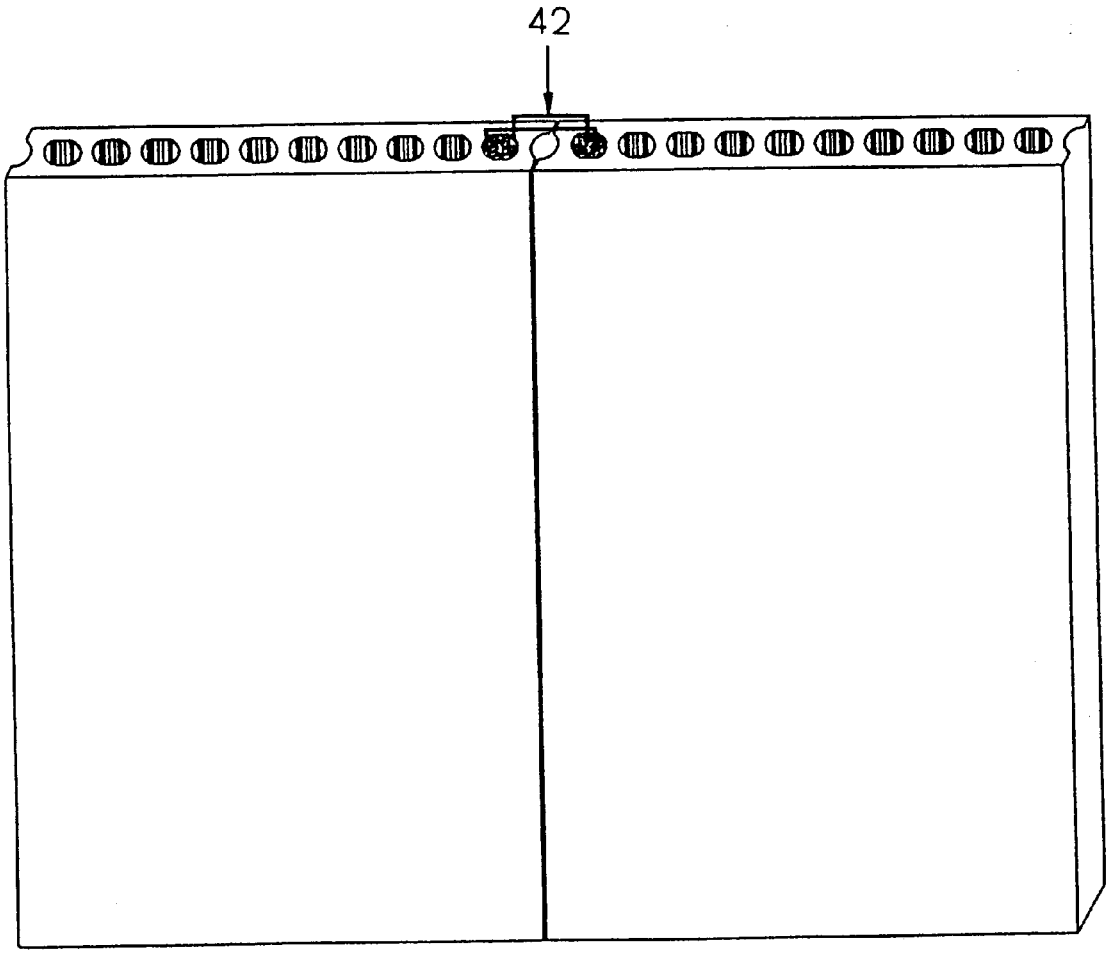

FIG. (22A) shows a perspective view of an assembly shown in FIG. 22.

FIG. (23) shows a perspective view of two adjacent linearly aligned pre-cast concrete walls being locked in position in single storey building.

FIG. (24A) shows top view plan of pre-cast concrete panels combination by using two numbers of 'L' shape and one number of 'I' shape whereby the length of 'I' shape panel can be adjusted at the casting stage to comply with architectural and structural requirements.

FIG. (24B) shows a side elevation view of combination of panels shown in FIG. (24A)

Figure 24A:
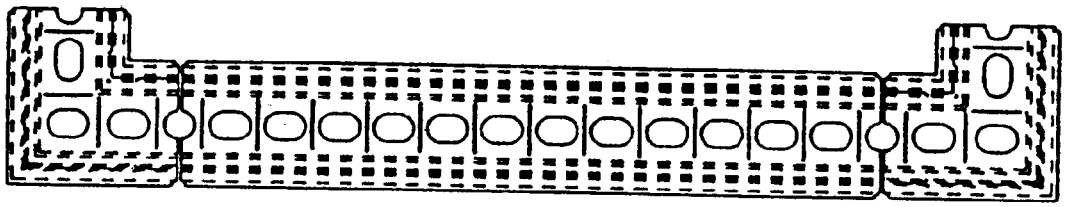
Figure 24B:
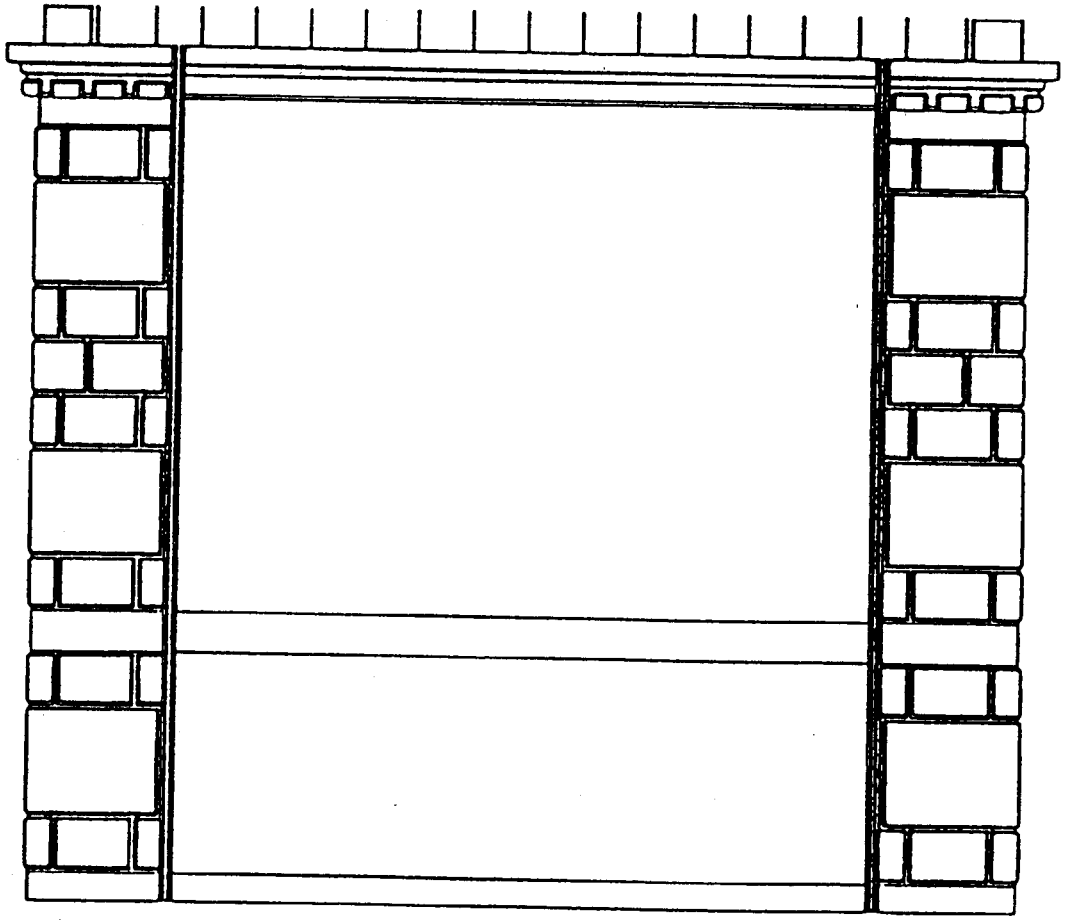
Figure 25A:
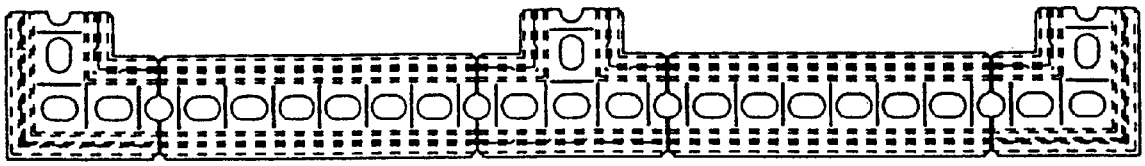
Figure 25B:
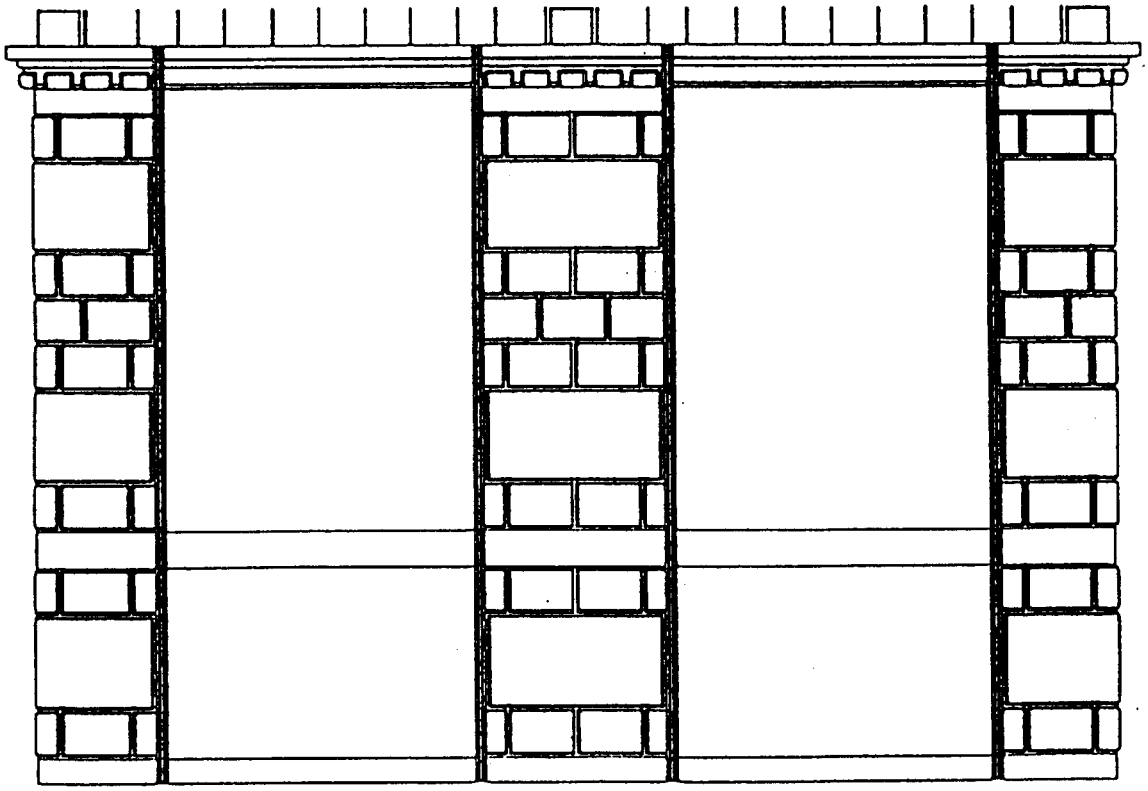
Figure 26A:
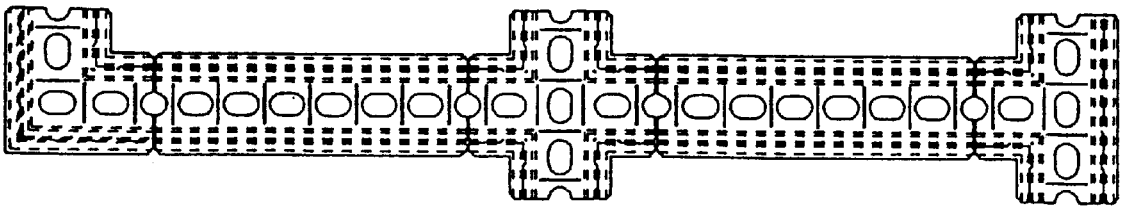
Figure 26B:
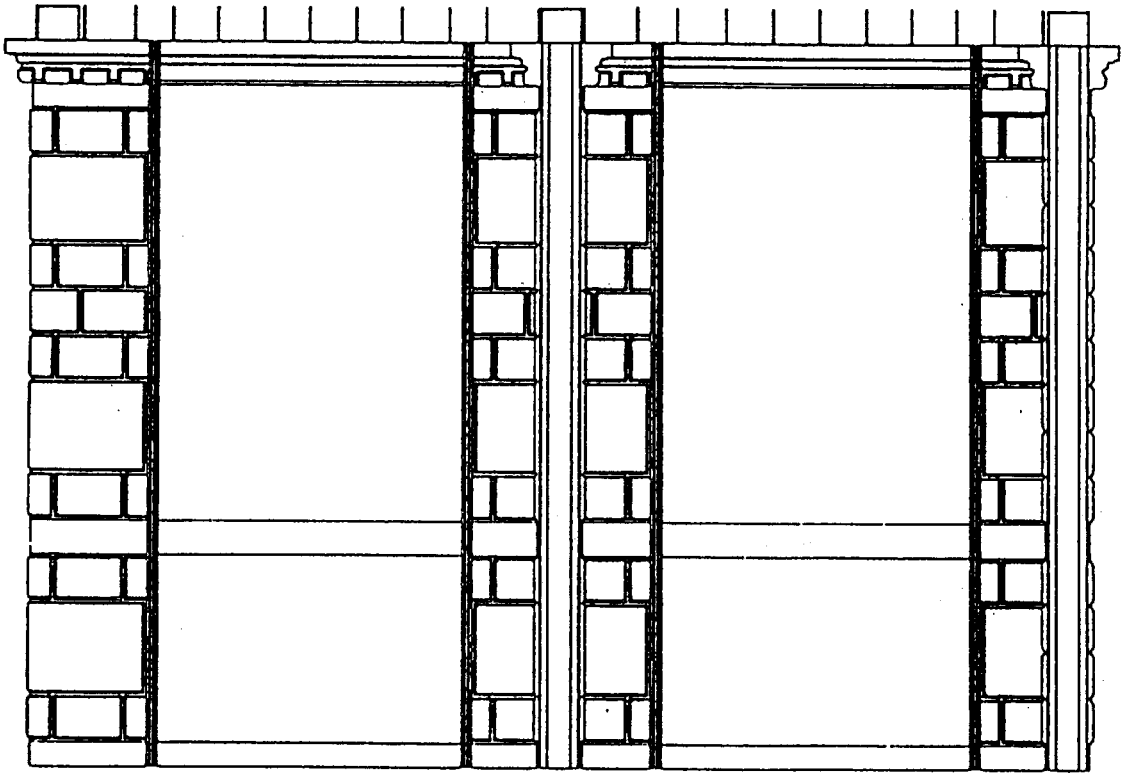
Figure 27A:
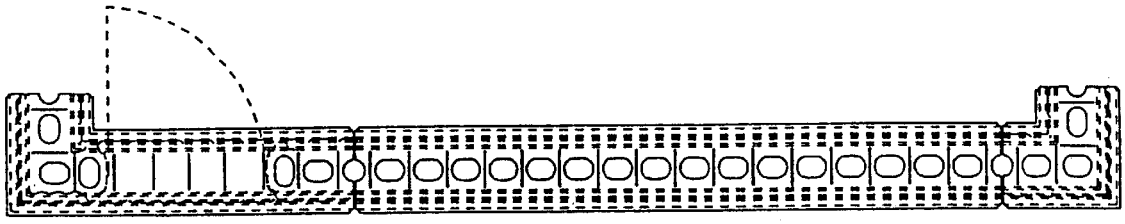
Figure 27B:
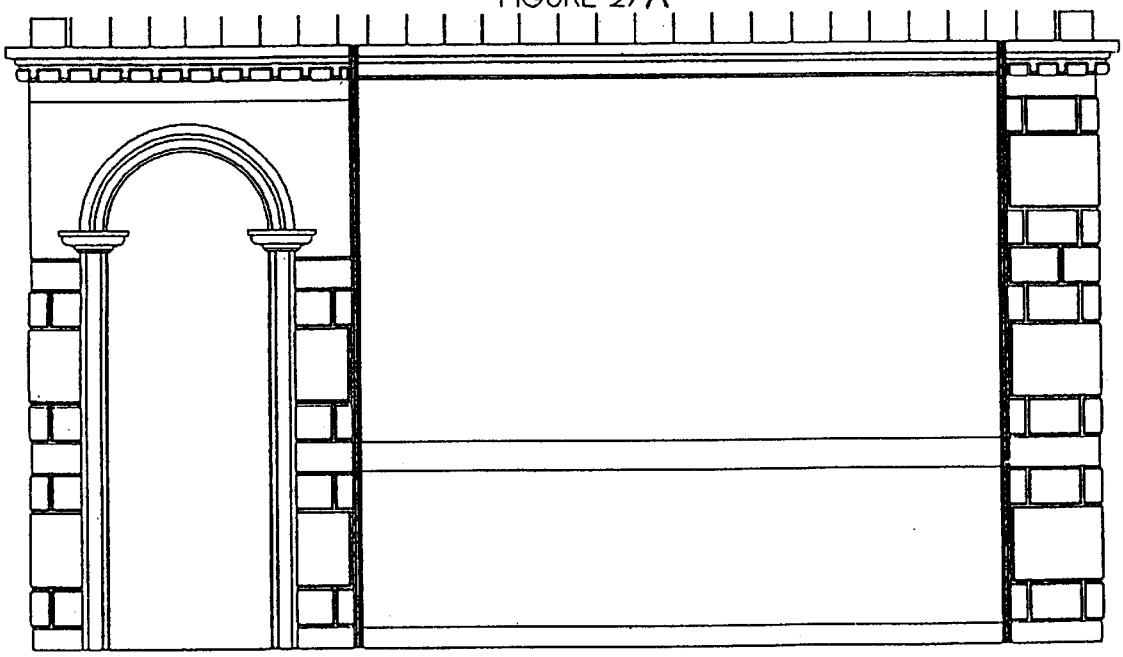
Figure 28A:
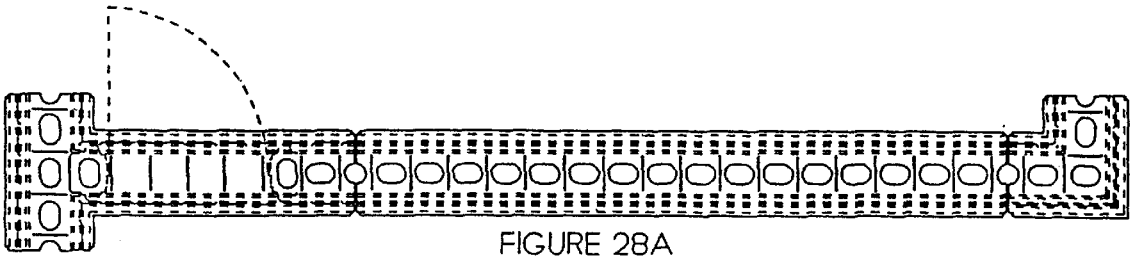
Figure 28B:
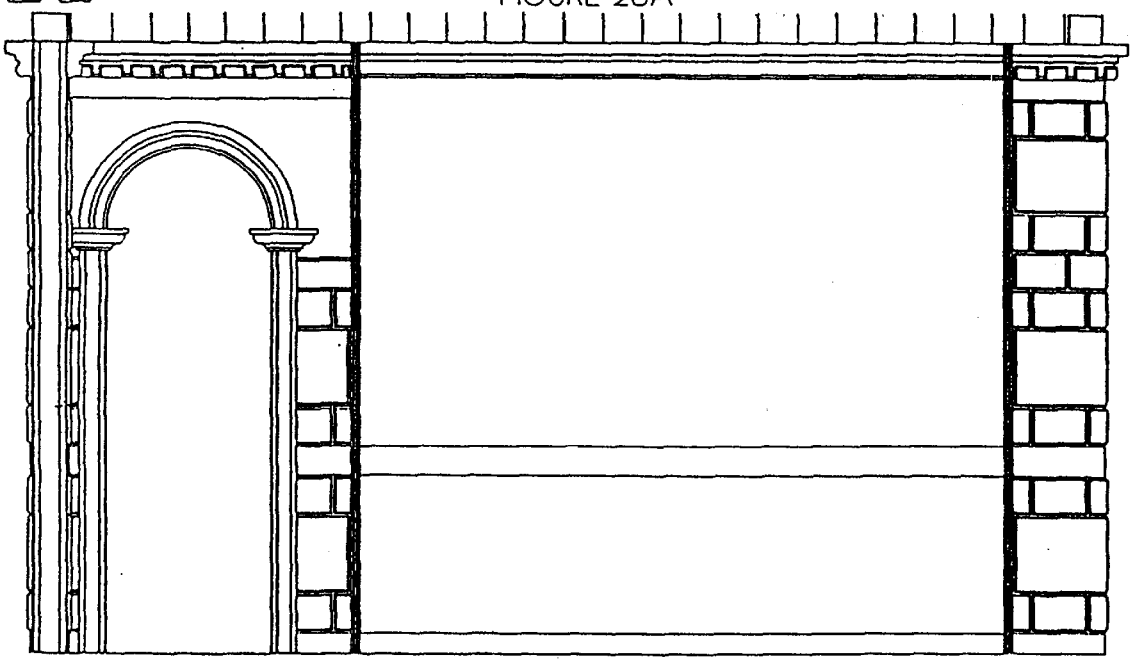
Figure 29A:
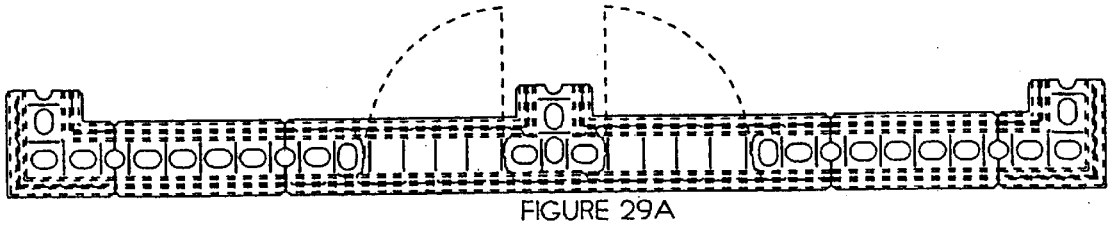
Figure 29B:
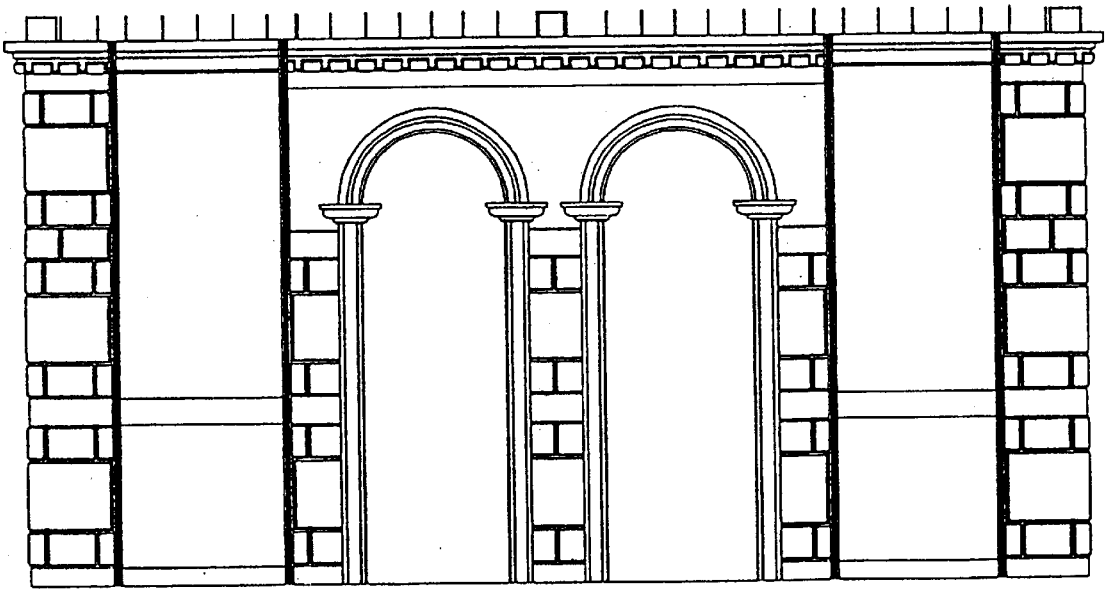
Figure 30A:
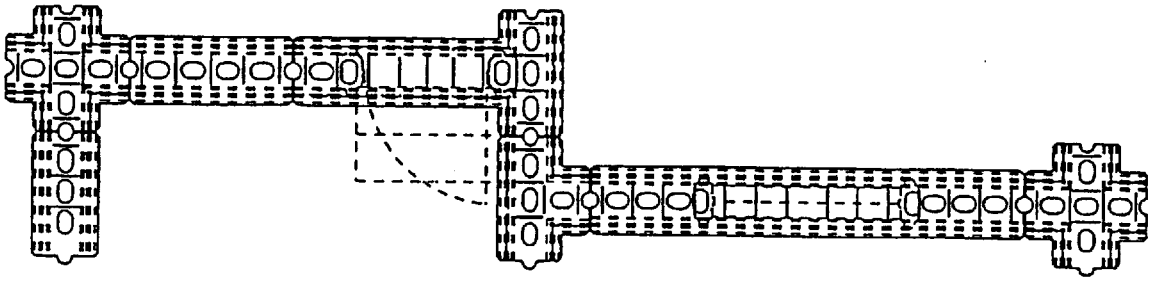
Figure 30B:
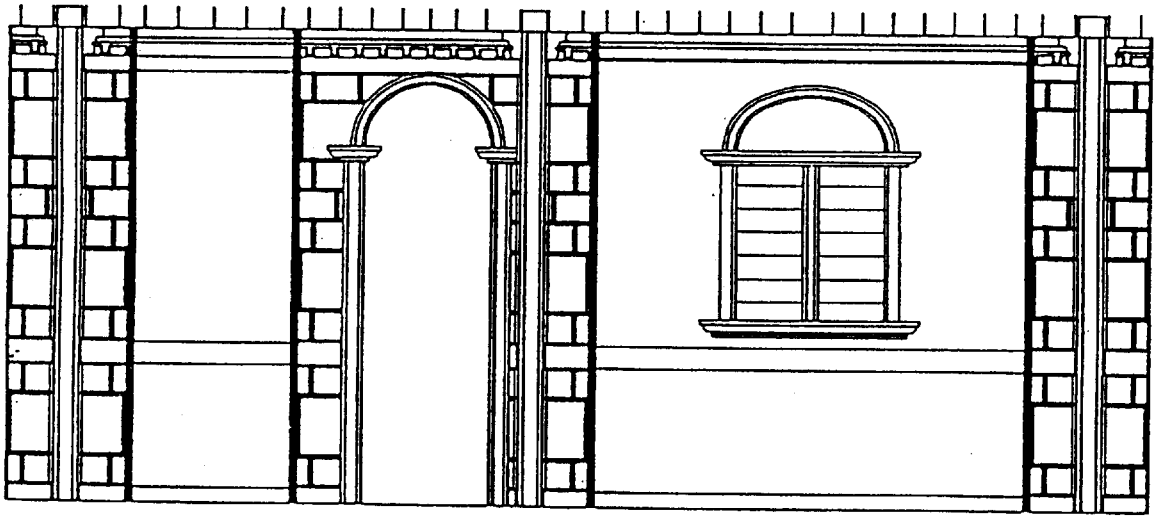
Figure 31A:
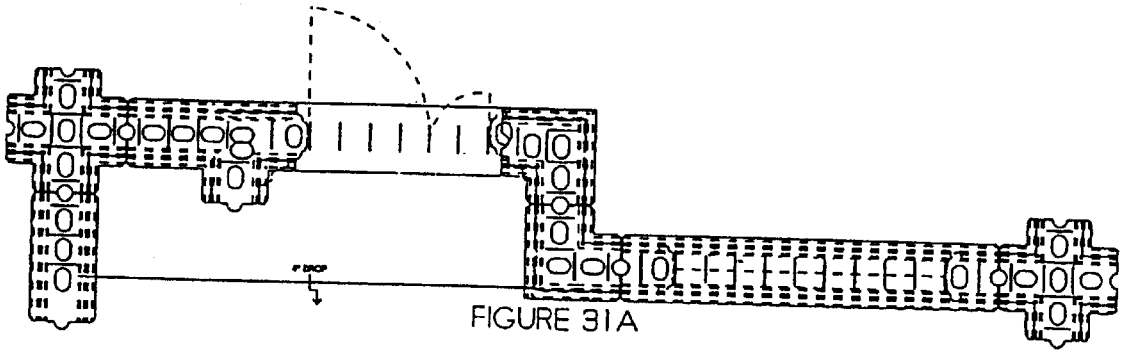
Figure 31B:
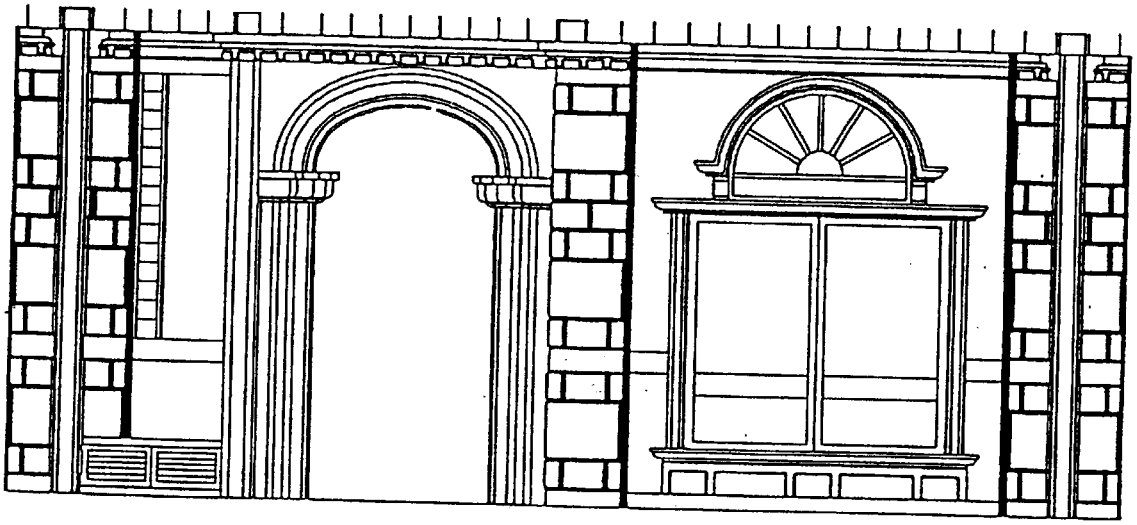
Figure 32A:
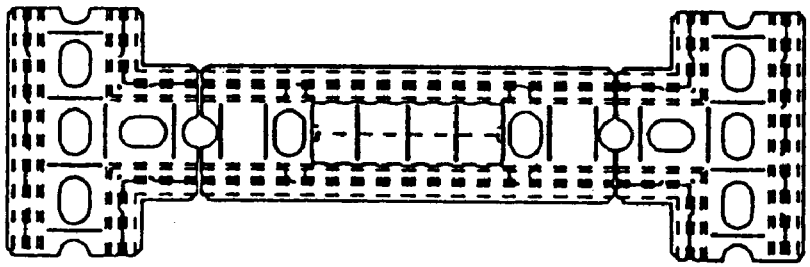
Figure 32B:
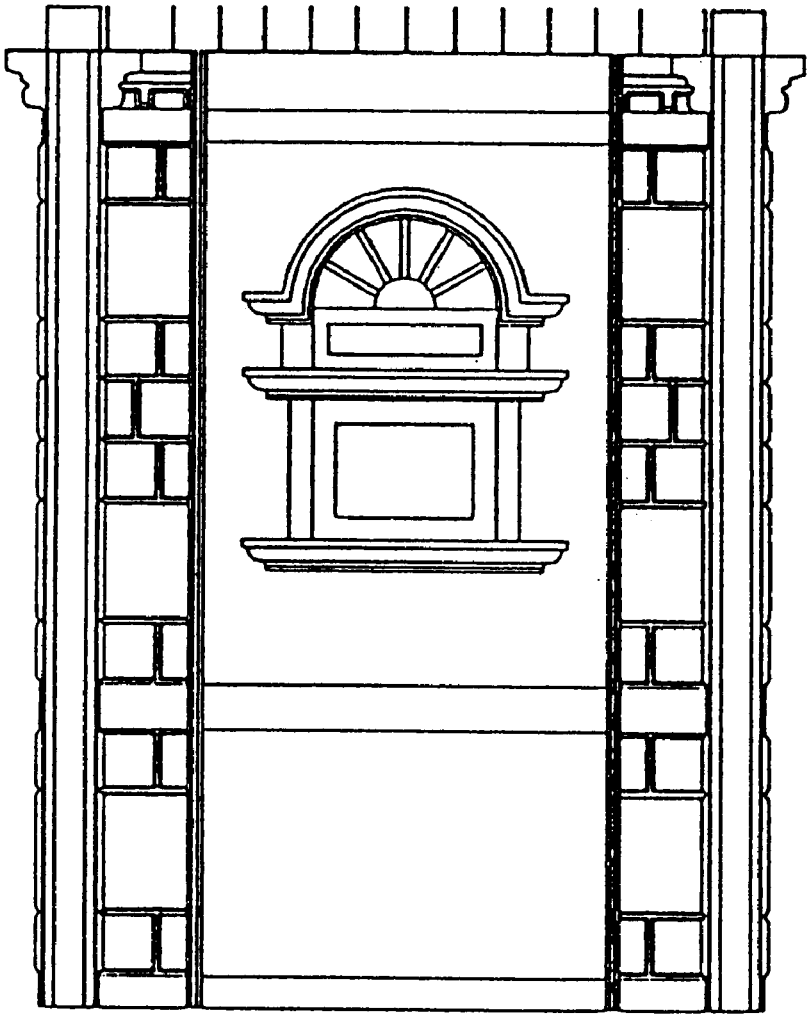
Figure 34A:
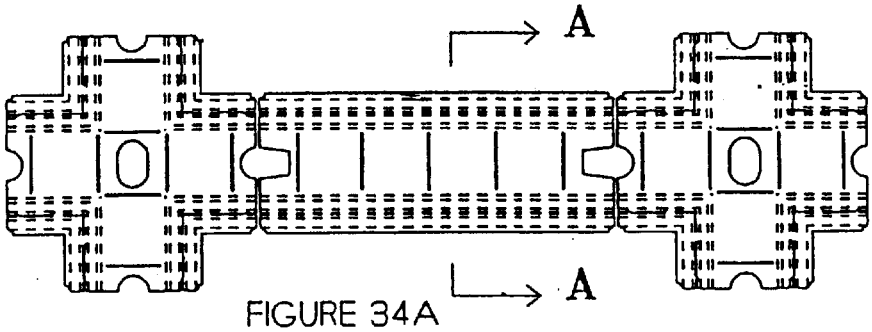
Figure 34C:
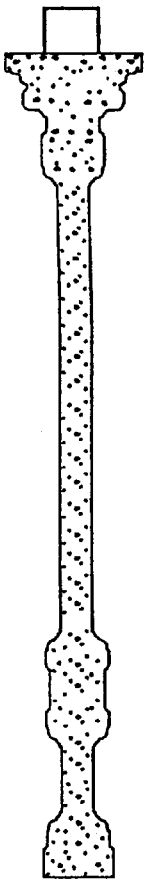
Figure 34B:
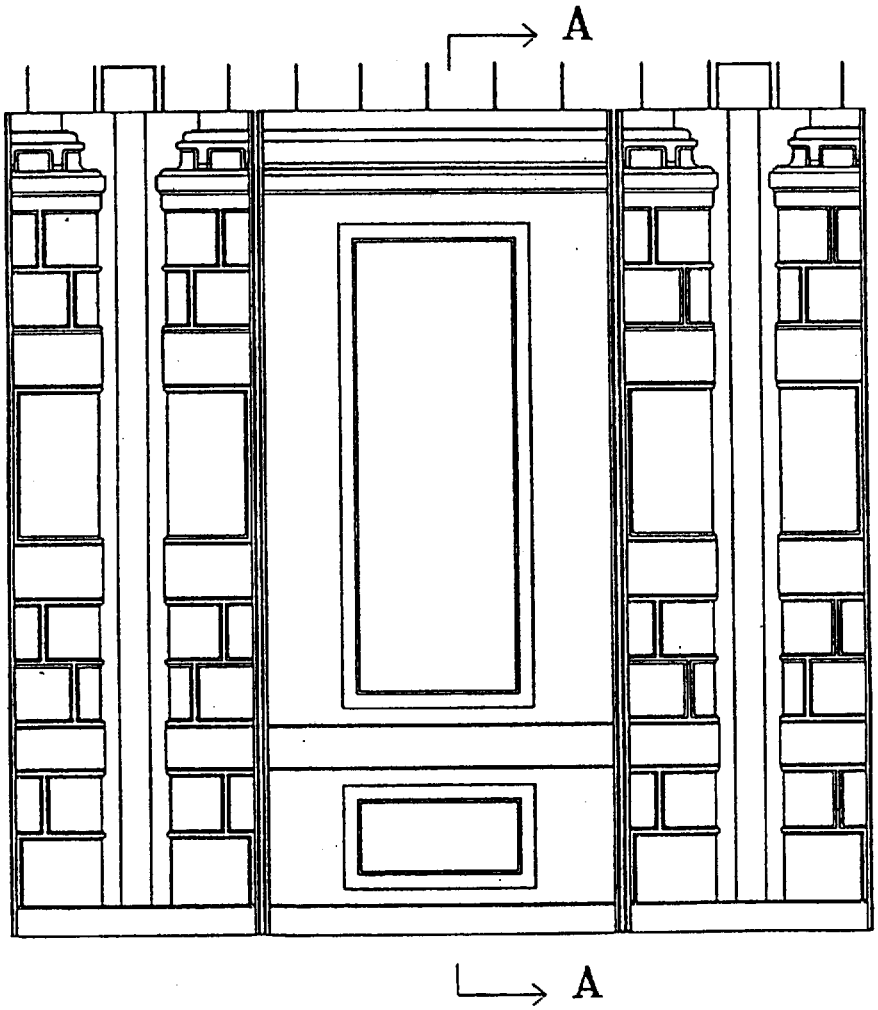

FIG. (25A) shows the top view plan of pre-cast concrete panels combination by using two numbers of 'L' shape, two numbers of 'I' shape and one number of 'T' shape panel whereby the length of 'I' shape can be adjusted at the casting stage to comply with architectural and structural requirements in FIG. 24A.

FIG. (25B) shows a side elevation view of combination of panels shown in FIG. (25A).

FIG. (26A) shows top view plan of pre-cast concrete panels combination by using one number of 'cross' shape, one number of 'T' shape, one number of 'L' shape and two numbers of 'I' shape panel whereby the length of 'I' shape can be adjusted at the pre-casting stage.

FIG. (26B) shows a side elevation view of combination of panels shown in FIG. (26A)

FIG. (27A) shows a top plan view of pre-cast concrete panels combination by one number of 'L' shape, one number of 'L' shape with door opening one number of 'I' shape panel.

FIG. (27B) shows a side elevation view of combination pre-cast concrete panels shown in FIG. (27A)

FIG. (28A) and FIG. (28B) to FIG. (32A) and FIG. (32B) shows various combinations of pre-cast concrete wall panels by using same method of combination as described from FIGS. 24A, 24B to 27A & 27B.

FIG. (33A) shows a top plan view of pre-cast concrete wall panels combination by using two numbers of 'cross' shape pre-cast concrete panels and one number of 'I' shape pre-cast concrete panel with a recess at both sides of the panel and without cores in between.

FIG. (33B) shows a side view of the elevation combination of pre-cast concrete wall panels shown in FIG. (33A)

FIG. (33C) shows section A—A view cut through the 'I' shape pre-cast concrete panel in the combination shown in FIGS. (33A) and (33B).

FIGS. (34A), (34B) and (34C) show a same combination as FIGS. (33A), (33B) and (33C) but with one core in the 'cross' shape panel.

Various modular pre-cast concrete panels will now be described. A first pre-cast concrete panel is a planar wall with 'I' shape with or without pre-cast concrete beam (2) and pre-cast concrete cornices (4) at the top edge (FIGS. 1A, 1B and 1C). The wall includes a plurality of evenly spaced apart cores (6) extending from the top edge to the bottom edge of the wall and steel links (8). The length (x) of the pre-cast concrete wall panel can be varied according to the structural design and architectural requirements of the building.

Figure 2A:
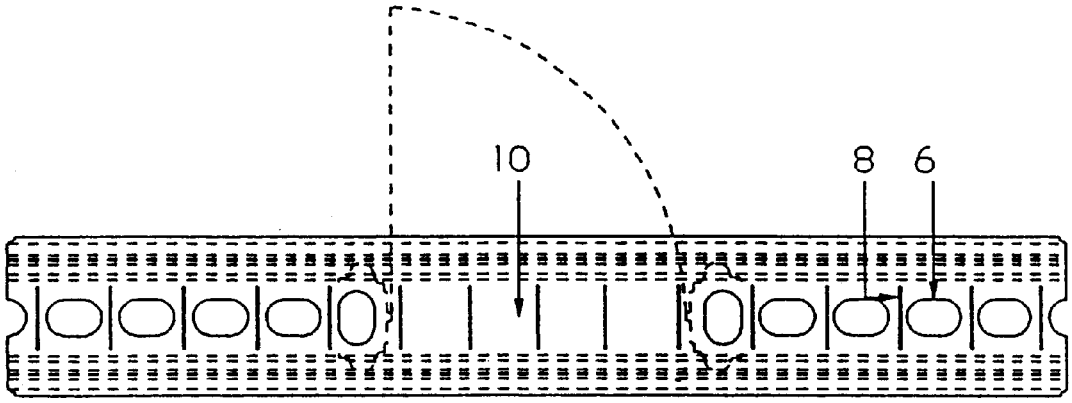
Figure 2B:
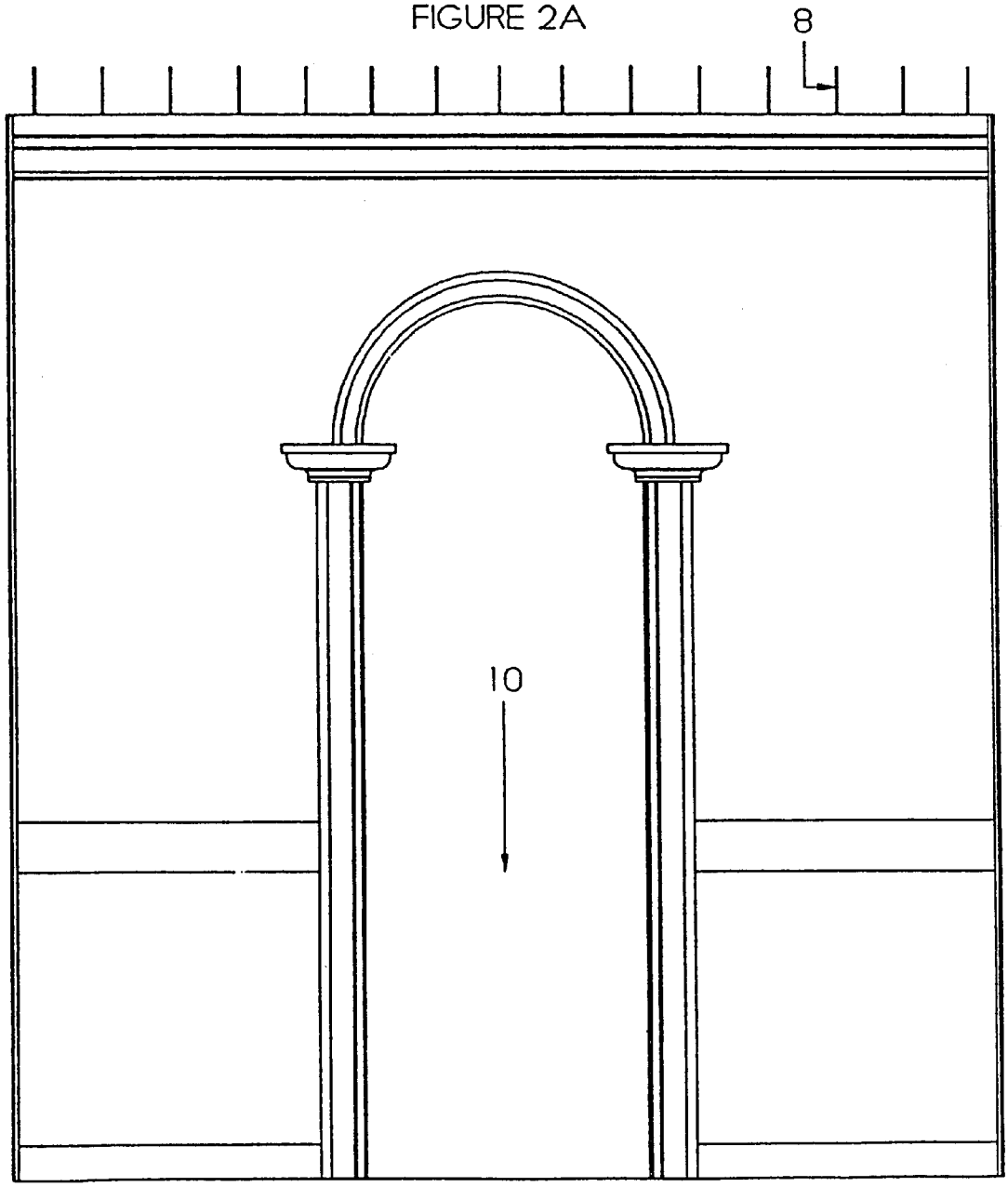
Figure 3A:
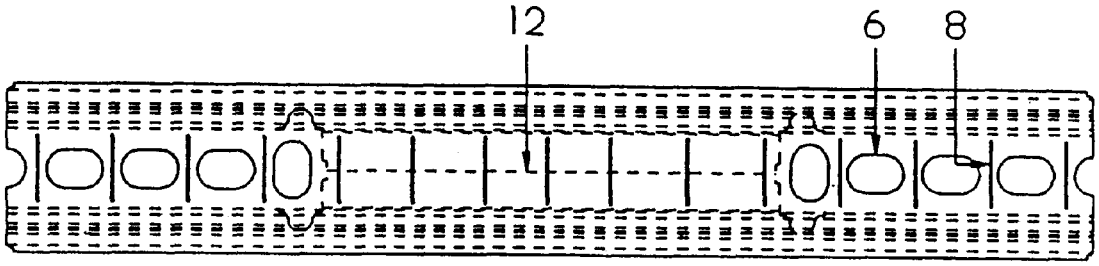
Figure 3B:
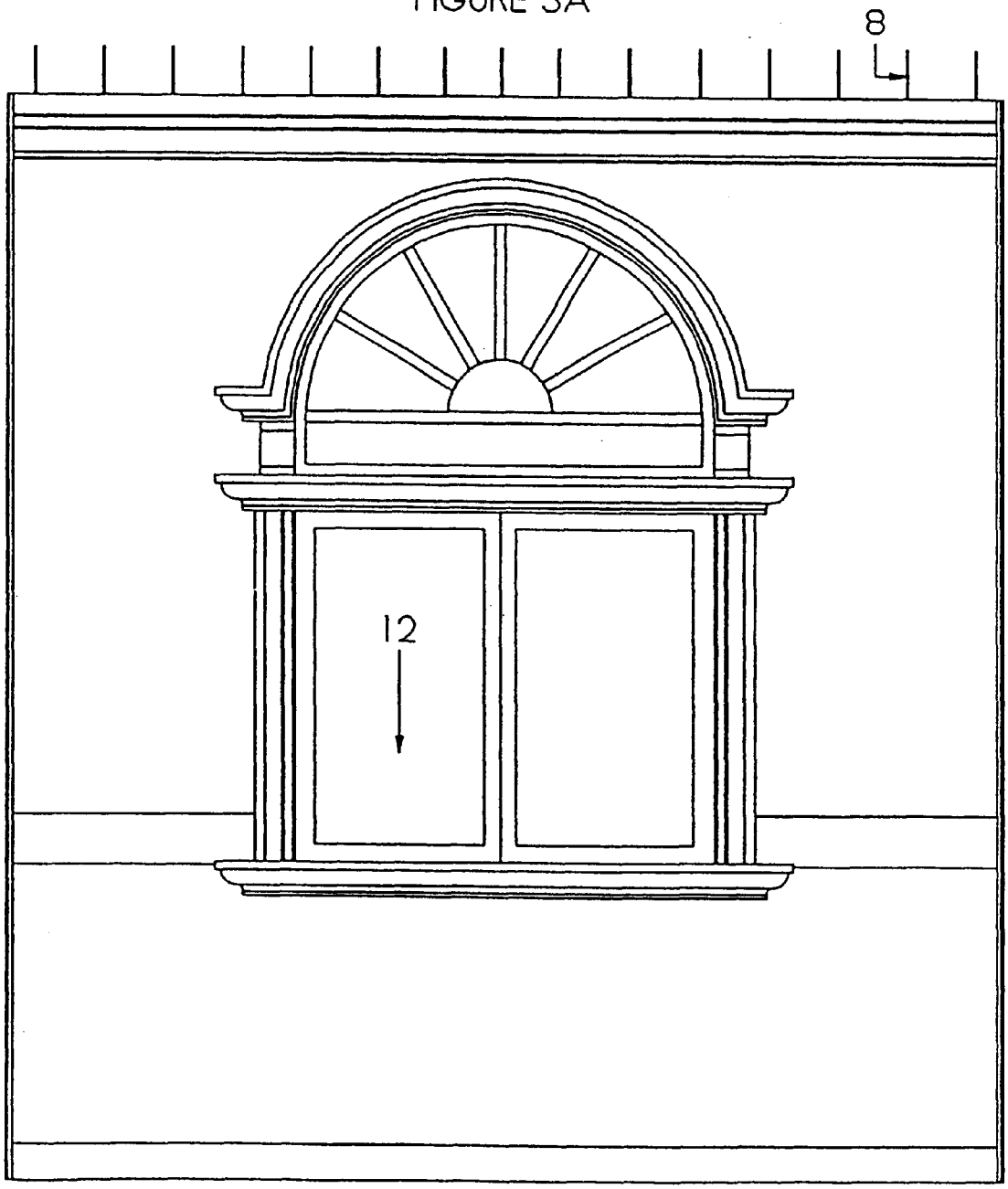

A second pre-cast concrete panel is a planer wall with 'I' shape as described in FIGS. 1A & 1B) but with a door opening (10) (See FIGS. 2A & 2B). A third pre-cast concrete panel is a 'I'shaped planar wall as described in FIGS. 1A, 1B & 1C) but with a window opening (12) (See FIGS. 3A & 3B). A fourth pre-cast concrete panel is a 'L' shaped panel (See FIGS. 4A, 4B & 4C). Each arm of 'L' shape panel includes a longitudinal core (6). The external sides (14) can be plain or patterned. The upper edges can include pre-cast concrete beam (2) and cornices (4) or be without the pre-cast concrete beam or cornice.

Figure 4A:
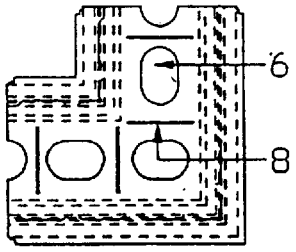
Figure 4C:
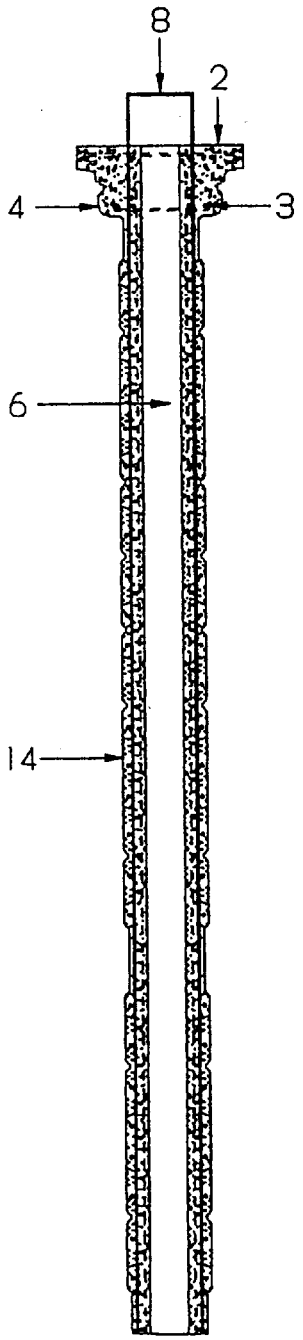
Figure 4B:
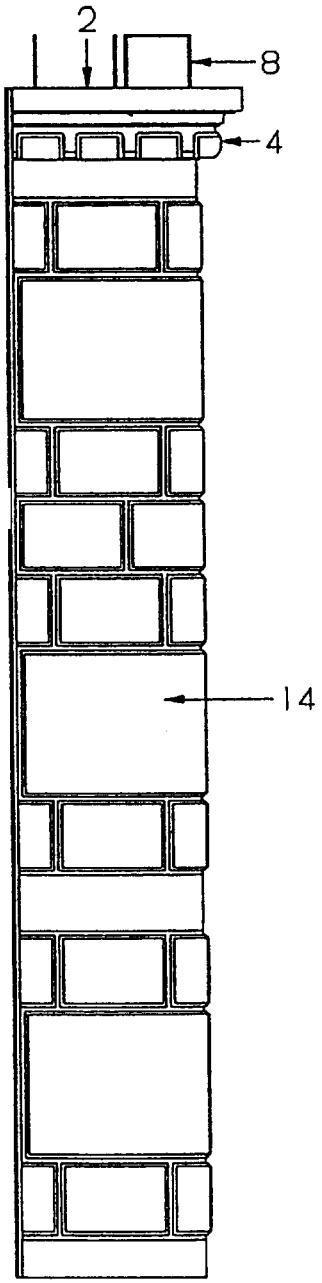
Figure 5A:
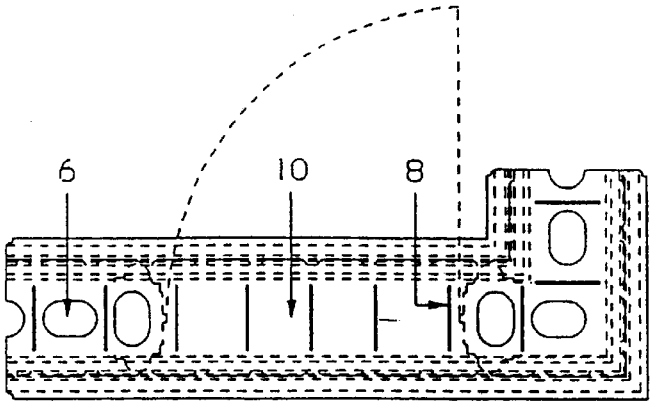
Figure 5B:
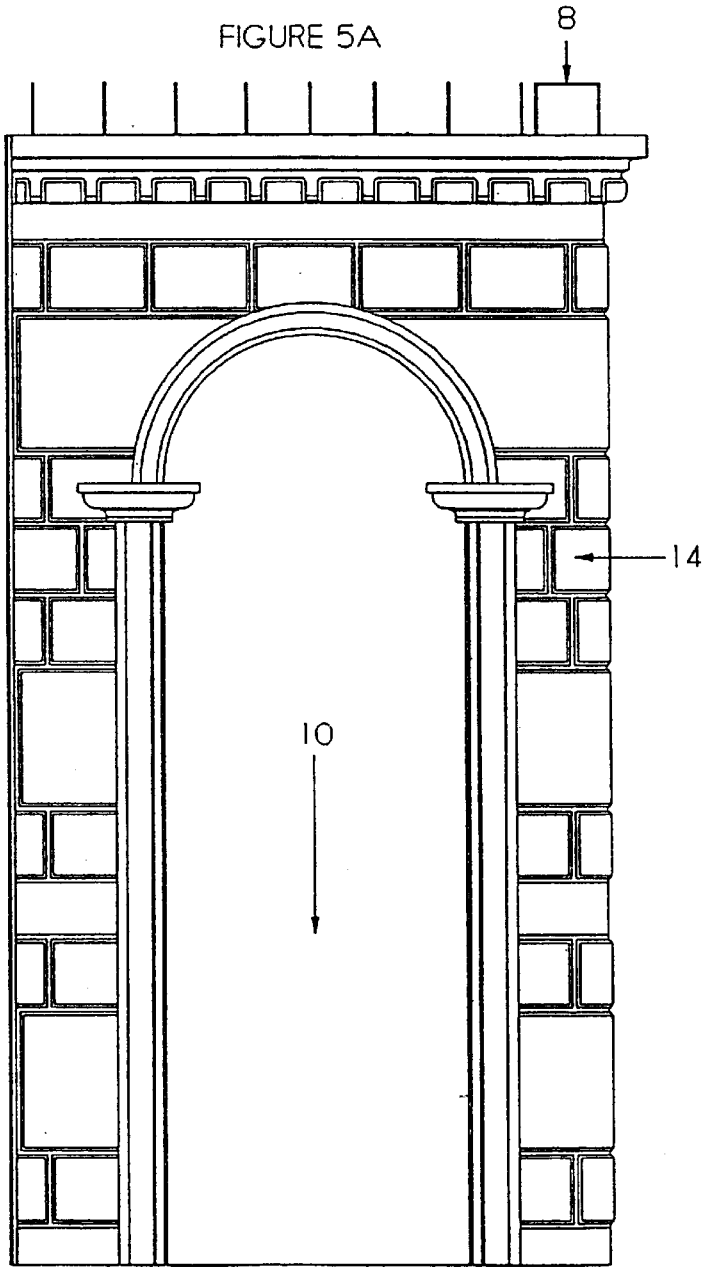
Figure 6A:
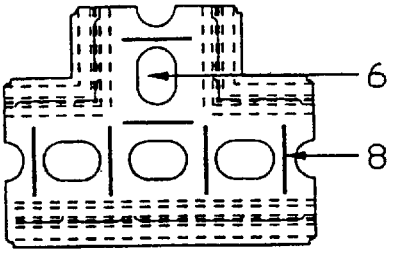
Figure 8A:
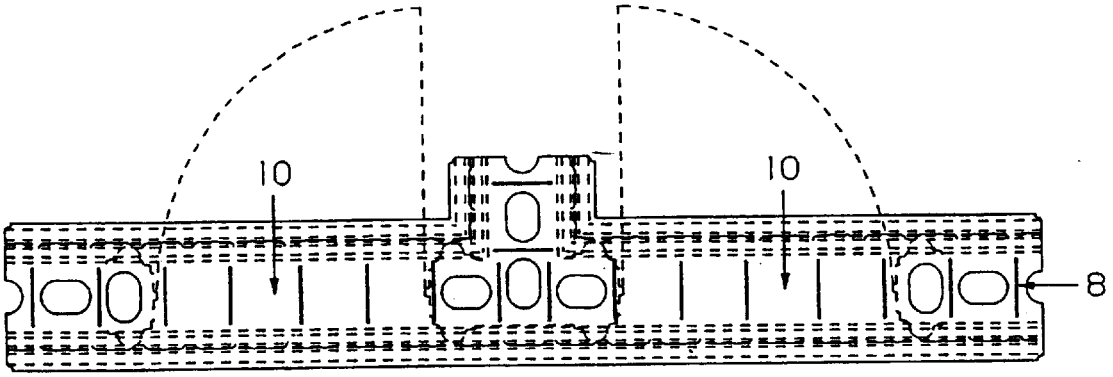
Figure 8B:
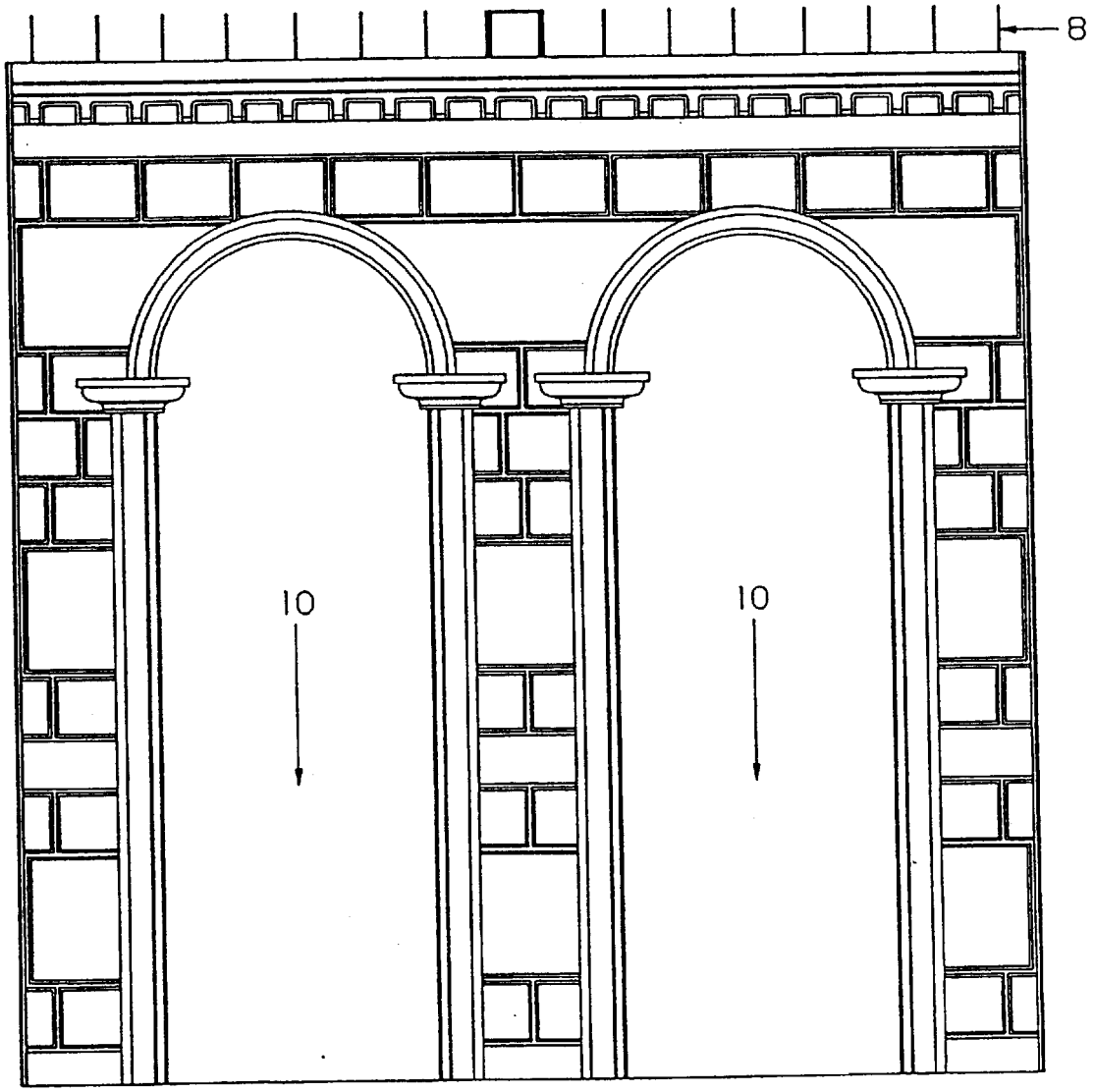
Figure 9A:
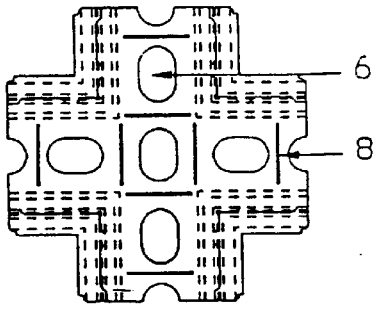
Figure 9C:
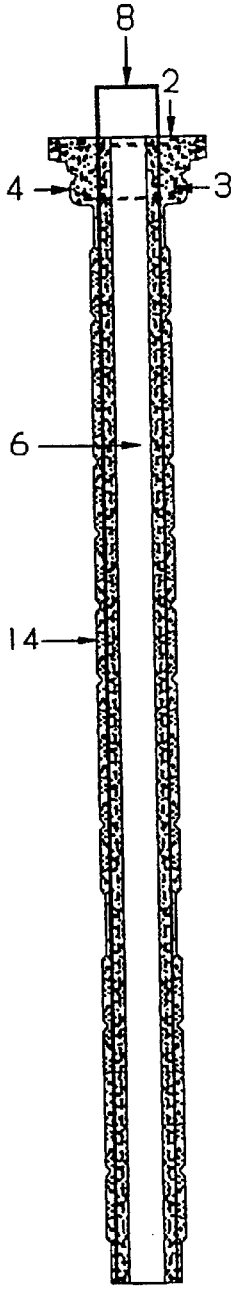
Figure 9B:
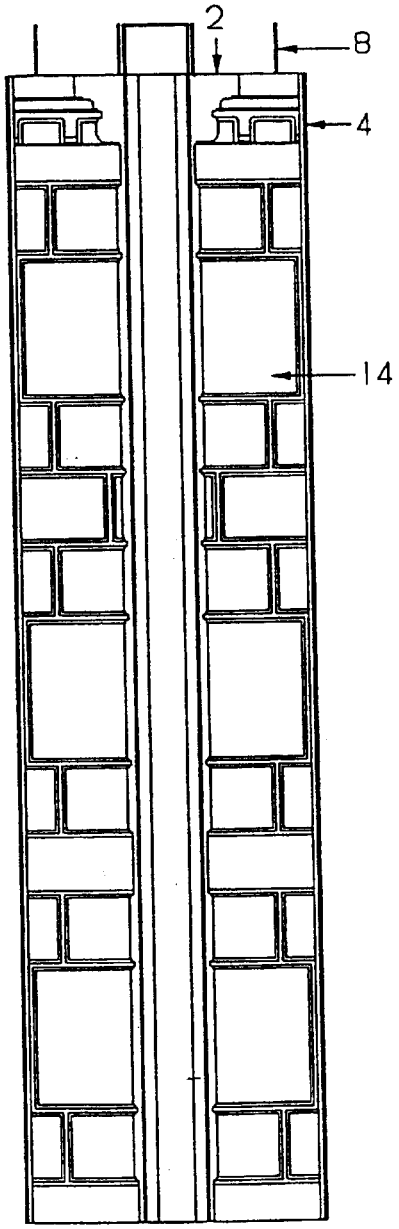

A fifth pre-cast concrete panel is 'L' shape unit as described in FIGS. 4A, 4B & 4C) but with one arm extended (see FIGS. 5A & 5B). The extended arm can include a door opening (10) or alternatively include window opening (12). A sixth pre-cast concrete panel is a 'T' shape unit with pre-cast concrete beam and pre-cast cornice as described in FIGS. 1A, 1B & 1C (see FIGS. 6A, 6B & 6C). A seventh pre-cast concrete panel is another 'T' shape unit where the middle arm in perpendicular relation to the other arm is extended and includes a door opening (10) or alternatively a window opening (12) as described in FIGS. 1A, 1B and 1C. A eighth pre-cast concrete panel is a 'T' shape wall structure with two door openings (12) (see FIGS. 8A & 8B). A ninth pre-cast concrete panel 'cross' sectional columnar unit, with at least one bore (6) in the panel (see FIGS. 9A, 9B & 9C). All the concrete panels described above may optionally include steel links (8) secured to the reinforcement steel bars (3) in the concrete beam (2) of the concrete wall panels. Further all the panels described above can be casted with or without pre-cast concrete beams and cornices.

It will be appreciated that the individual dimensions of the various parameters such as height, length and thickness of the panel, shapes and designs of the window opening or door opening, patterns on the side wall can be different depending on architectural requirements. The combination selected from the above described pre-cast concrete panels will form any design and any size of a building the except some length of the 'I' shaped panel will have to adjusted at the casting stage. Pre-cast concrete panel of other cross-sectional types can be envisaged for other requirements. Such pre-cast concrete panels would be within the scope of this invention.

Figure 11:
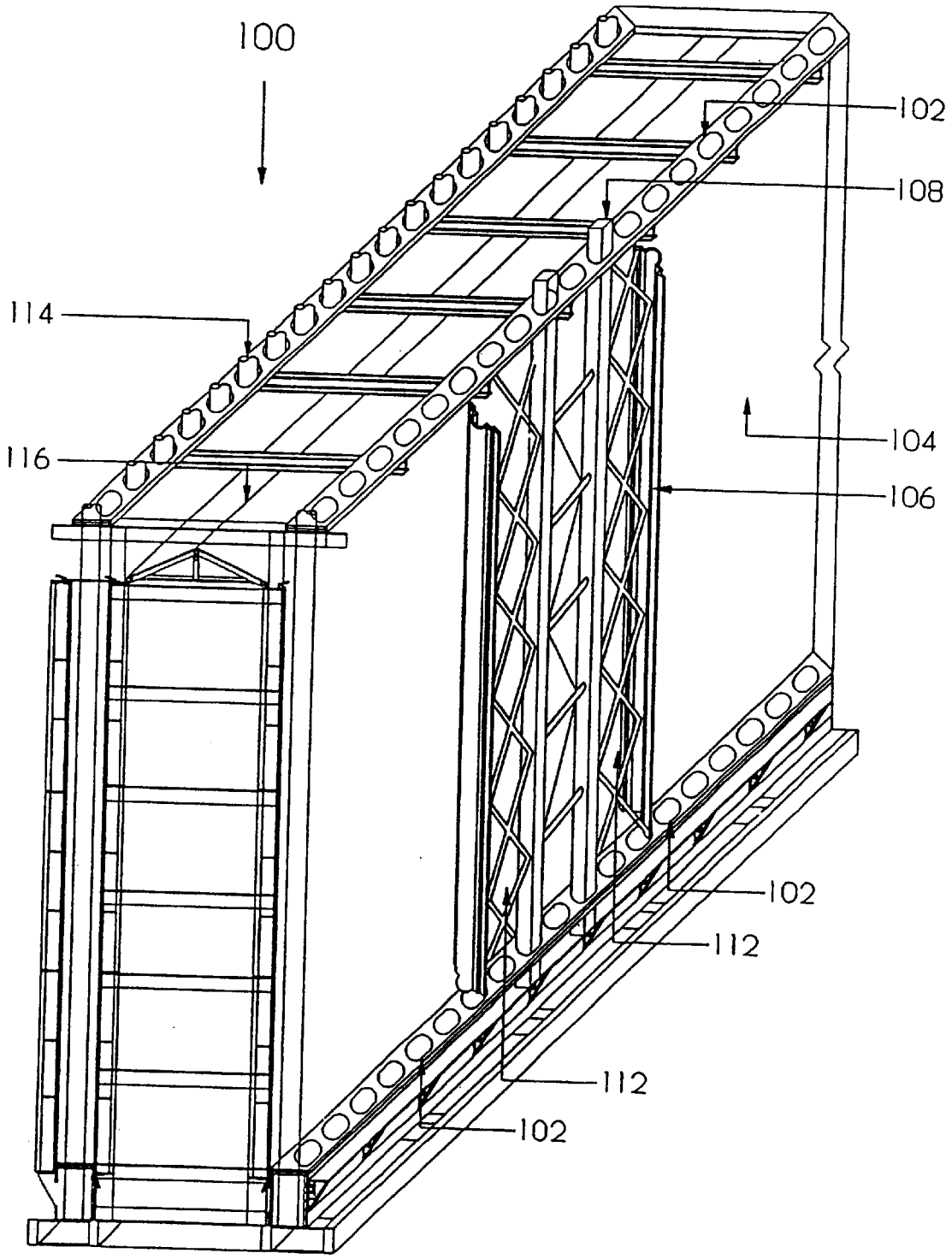
Figure 11A:
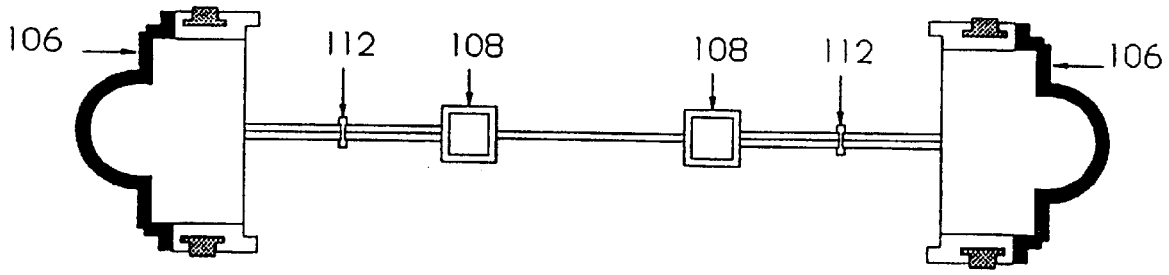
Figure 11B:
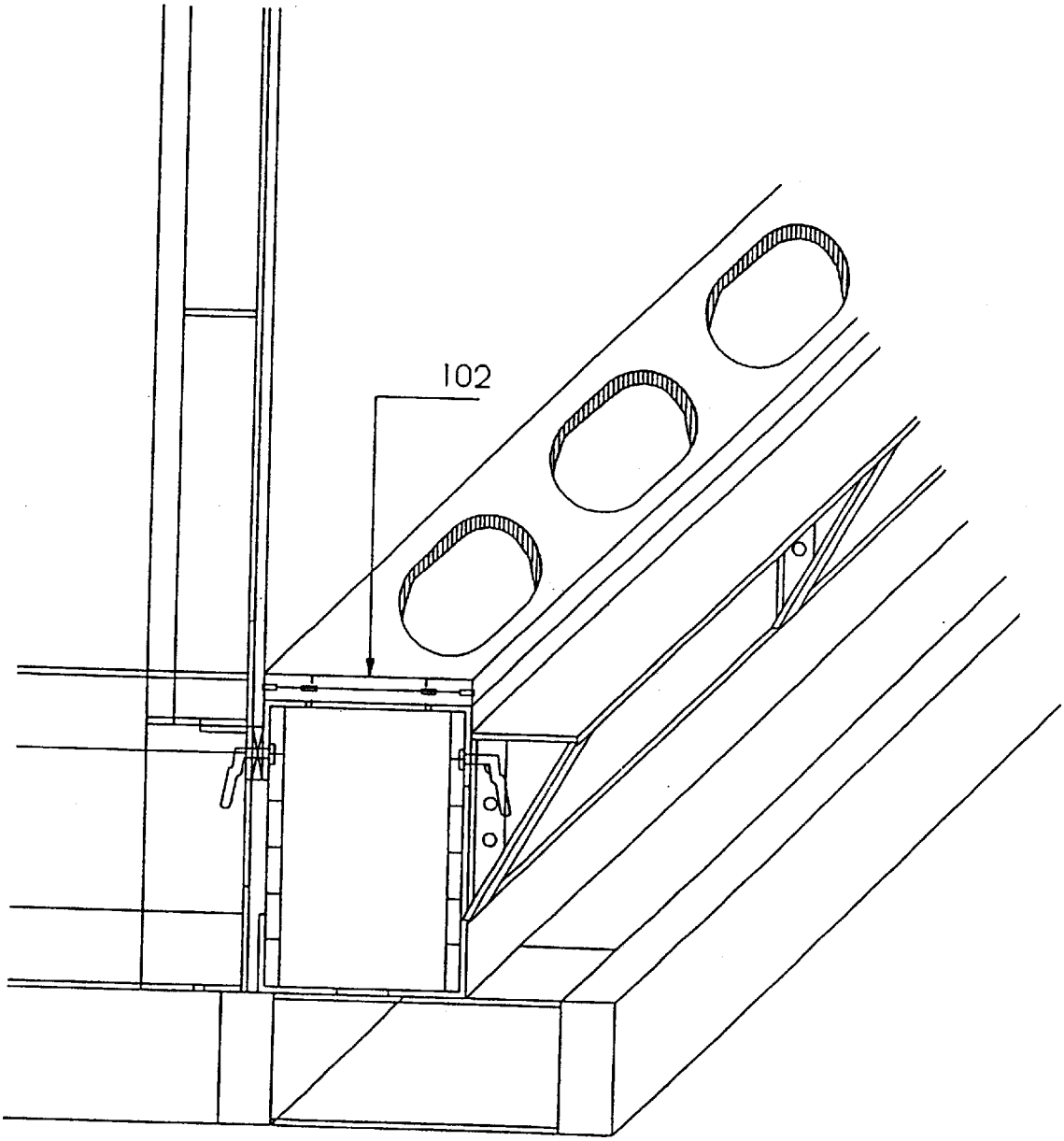

The mould (100) comprises of a twin set of mould formworks. Each set of mould formwork comprises of a pair of horizontally placed but spaced apart guide plates (102) and a pair of side panel plates (104). The vertical length of the concrete wall panel to be casted can be varied by adjusting the height of the bottom guide plate (102) upward and downward utilising conventional means known to the art (see FIG. 11B). In the preferred embodiment, the bottom guide plate (102) is raised or lowered by means of slot and bolt means (see FIG. 11B).

The mould (100) includes a means to vary the length of the yet to be casted concrete wall panels. The means include a pair of vertical adapter(106) extending from the top of bottom guide plate to under-side of top guide plate (102). A pair of shafts (108) are introduced through the holes (110) in the horizontal guide plates (102), top and bottom. A plurality of extendable arms (112) are arranged spaced apart between the shaft and the vertical adapter(106). The extendable arms (112) extend from one vertical adapter to the other, whereby the distance apart between the vertical adapters can be varied over a pre-determined range. Collapsible cylindrical tubes (114) are introduced into the holes in the horizontal guide plates. After the wire mesh was placed in position, concrete is introduced into the mould by pouring the concrete across the inverted V shape ledge (116). The concrete is introduced into both sides of the inverted V shaped ledge (116) until the moulds are field with concrete.

Figure 6C:
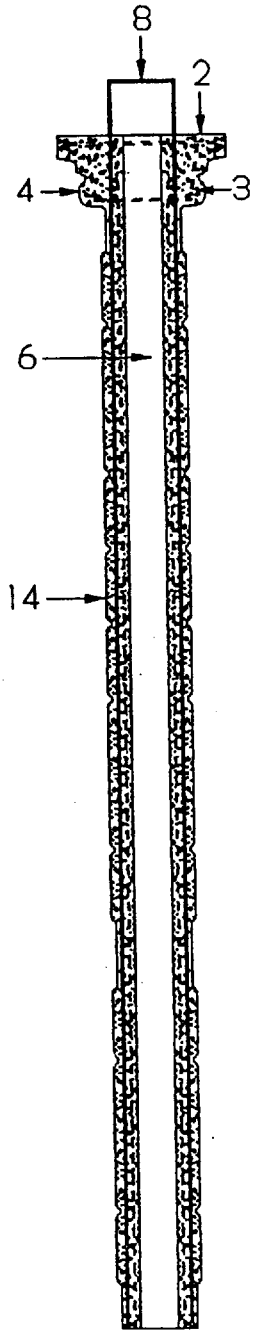
Figure 6B:
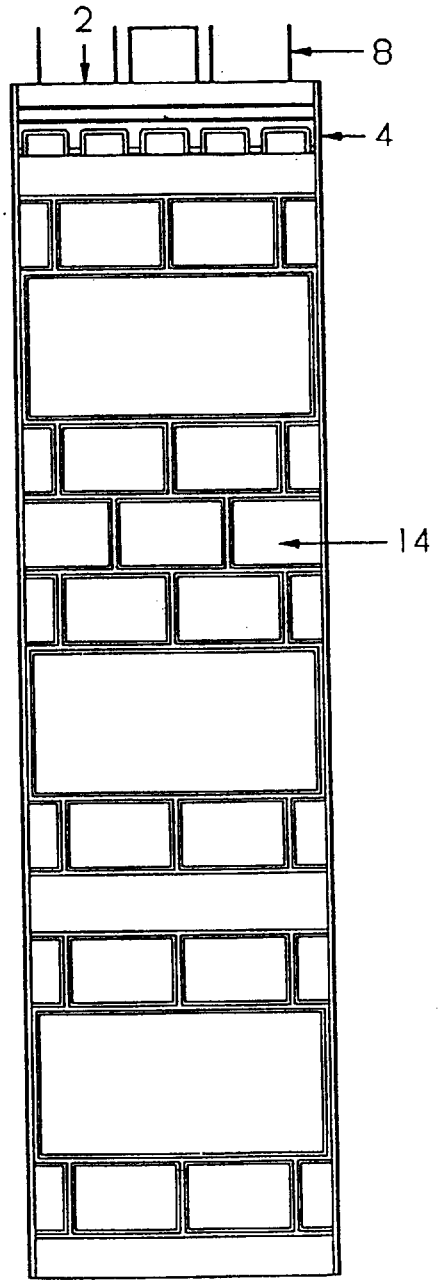
Figure 7A:
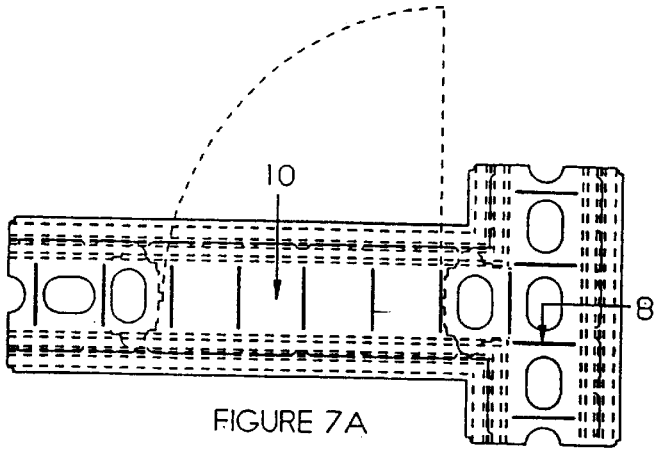
Figure 7B:
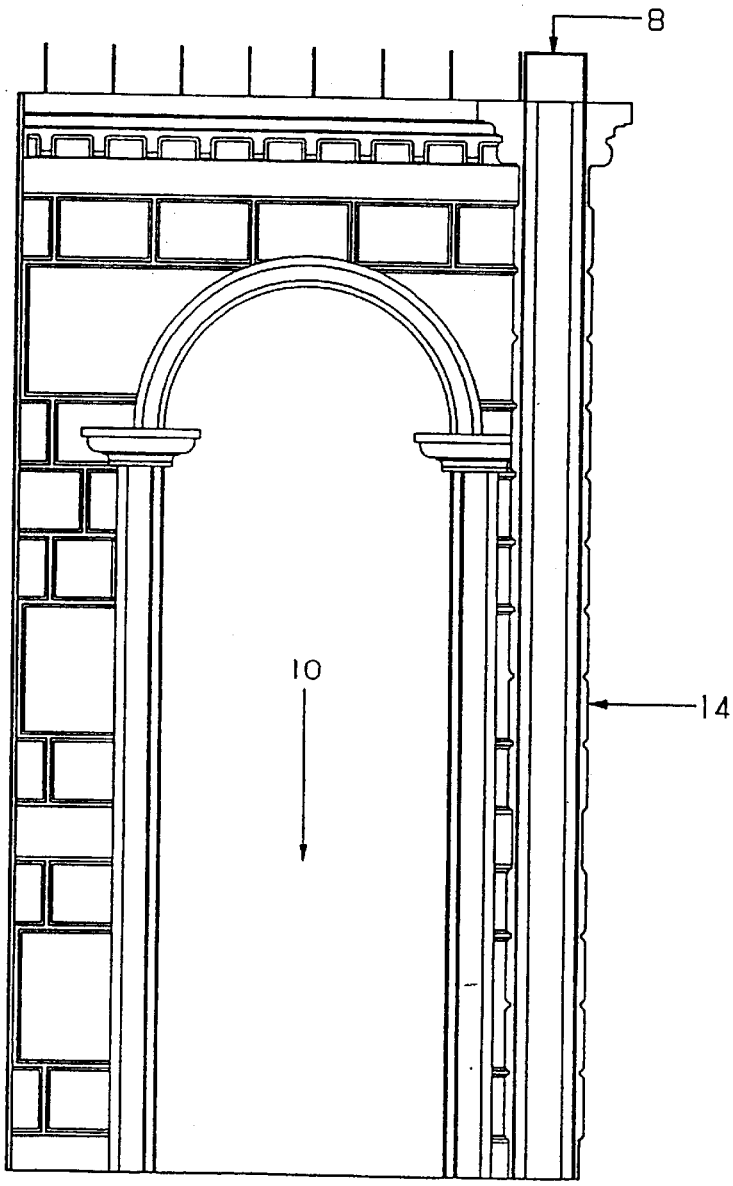

It will be appreciated that concrete beam (2) and various designs such as cornices (4) and patterns (14) can be incorporated onto the side panels (104) of the mould. An example of a pattern incorporated into the side panels is shown in FIGS. 6B and 6C. The cornices (4) and the patterned sides (14) can be provided on one side or on both sides.

Figure 12:
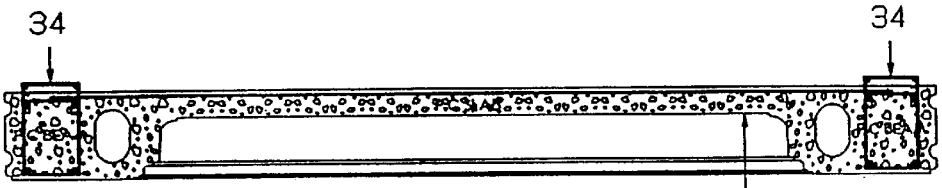
Figure 13:
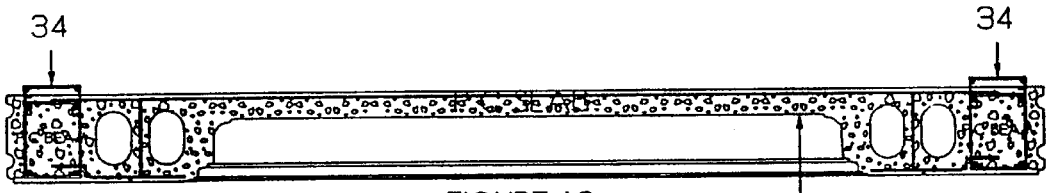
Figure 14:
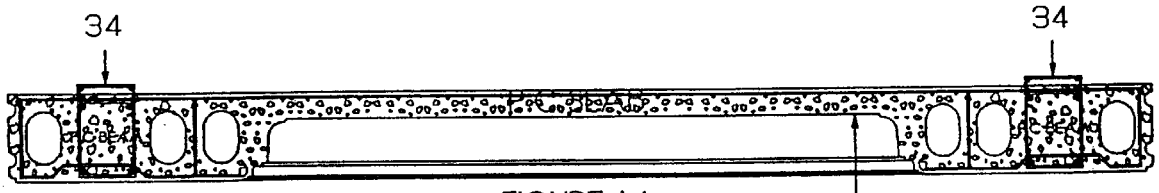

FIGS. 12, 13 and 14 shown pre-cast concrete slabs of different lengths. Each pre-cast concrete slab is a rectangular slab, with a concrete beam around the perimeter. The concrete beam can include a hollow core if necessary. The perimeter edge further includes pre-cast concrete beam (34). The heights of the concrete beam and the corresponding depth of the recess can be adjusted at casting stage in accordance with architectural and engineering requirements.

In constructing a building, the pre-cast concrete panels as stated above will be erected, supported and interlocked together by the following methods.

Step 1. Cast the ground floor concrete (13) and extend the starter bars (16) out at the predetermined column position (15). FIG. (15A)

Step 2. Constructed the concrete kicker (18) and adjust the level to receive the pre-cast concrete wall panels and cast-in-situ columns FIGS. (15B)(15C).

Step 3. Lift up the pre-cast concrete wall panels and erect to the respective positions. FIG. 16.

Step 4. Insert the reinforcement steel bars (19) to the respective cores at column positions, and complete with the in fill concrete. FIGS. (17A)(17B).

Step 5. Seal up the gaps in between linearly aligned adjacent pre-cast concrete wall panels by fitting in P. V. C gasket (20) introducing sealant compound (22) then introducing in-fill concrete. FIG. (18). Unused hollow cores in the pre-cast concrete wall panels are covered by inserting P. V. C caps (24) before pouring the concrete into the mould. FIGS. (18A)(18B).

Step 6. Lift up the pre-cast concrete slab (26) and lay on the pre-cast concrete beams (2) of pre-cast concrete wall panels. FIG. (19)

Step 7. Insert the reinforcement steel bars (28) through the links (8) extending from the pre-cast concrete beam(2) of the pre-cast concrete walls. FIG. (20) and FIG. (20A)

Step 8. Add the wire mesh (38) to the top of the pre-cast concrete floor slabs and top bars (40) to the top of pre-cast concrete beams. FIG. (22) and FIG. (22A)

Step 9. Pour the concrete to the assembly in FIG. (22A). All the pre-cast concrete walls, pre-cast concrete beams and pre-cast concrete slabs will be inter-linked and interlocked together to produce a unified overall structure.

Step 10. Repeat the steps 3 to 9 for the next floor.

For single storey, the pre-cast concrete wall panels will be inter-linked and interlocked together by inserting U shape steel bars (42) after pouring the concrete to column positioned next to each other from two linearly aligned adjacent pre-cast concrete wall panels. FIG. (23).

Figure 21A:
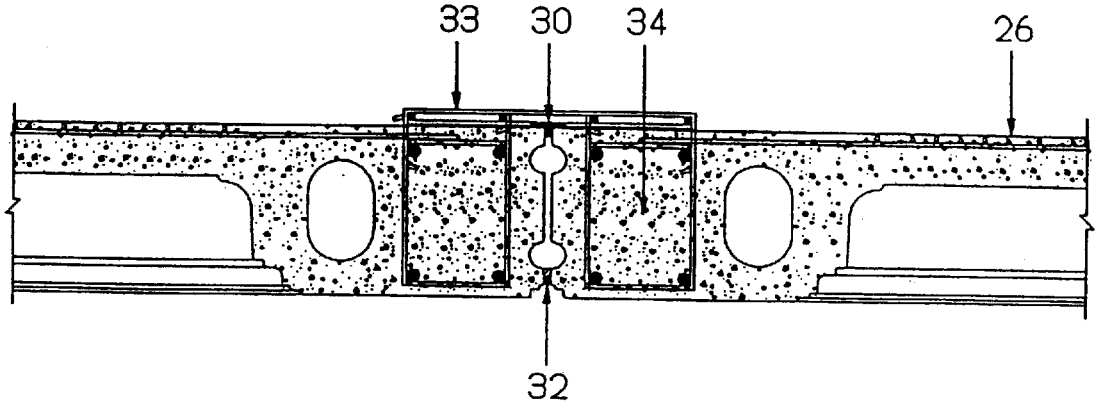
Figure 21B:
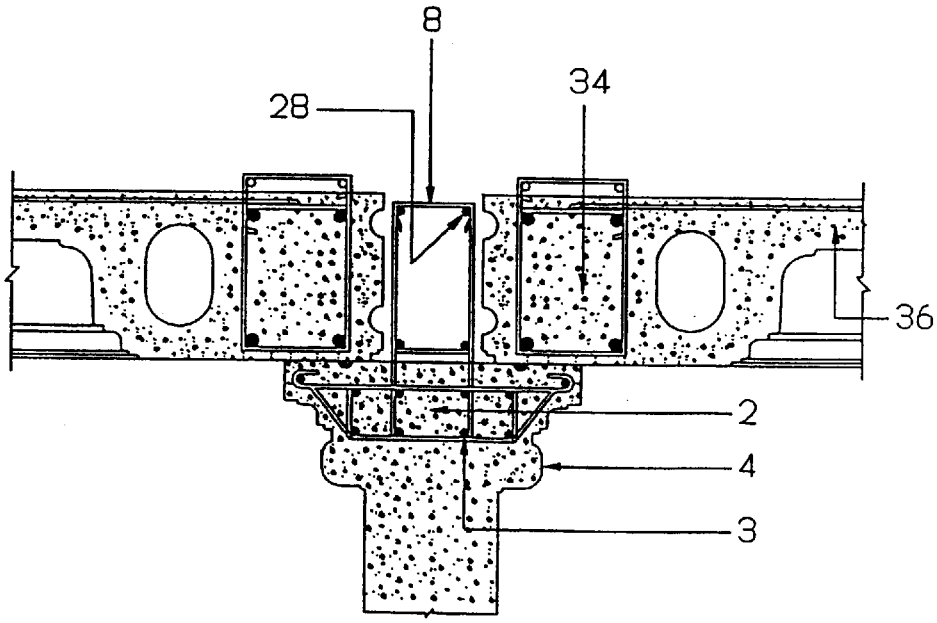

One edge of a concrete slab is connected to the edge of another adjacent concrete slab by placing the two concrete slabs adjacent to each other and inter-linking pre-cast concrete beam of the pre-cast concrete slab by steel bars (33). Any crevice or gap at the joint of the two concrete slabs is sealed with a suitable sealant (32) (See FIG. 21A).

Where a reinforced concrete beam is to be constructed between two adjacent concrete slabs, or where a wall is to be erected from one storey to another, than the each concrete slab (26) is placed on the concrete beam (2) of a concrete wall panel. One side of a concrete slab is placed spaced apart from the side of an adjacent concrete slab. A trough is formed by the side edges of the concrete slabs and the top surface of the concrete wall panel. Additional steel bars (28) are placed in the trough and secured to the steel links (8) to form a steel cage. Concrete is poured into the trough so formed and allowed to set to form a reinforced concrete beam. If desired additional concrete wall can be erected above this reinforced concrete beam by placing a concrete wall panel over the reinforced concrete. (See FIG. 22)

The advantage of this invention is that the various shapes of pre-cast concrete panels can be assembled, concrete columns are constructed by the introduction of reinforcement steel bars and concrete into the desired cores, cast in-situ reinforcement concrete beams are constructed on top of pre-cast concrete walls and adjacent concrete slab panels, and all reinforcement steel bars can be inter-linked to form a rigid and sturdy building structure. The system provides great flexibility in constructing various types of buildings by the judicious selection of the appropriate types of pre-cast concrete panels. The length of 'I' shaped concrete panels can be varied according to architectural requirements and the length adjusted by adjusting the universal moulding formwork set. The FIGS. (24) to FIG. (32) showing the plans and elevations for the various type of combination from pre-cast concrete wall panels to form the different designs according to architectural requirements. The specific design of the surface of the wall panel cornices, door frames, window frames and other structures can be easily formed or modified prior to the casting. Furthermore, it is easy to handle the casting and construction and quality is under control at casting plants instead of depending on inconsistent human factor. There is no plastering and no ceiling because the wall and ceiling furnishings can be formed during the process of casting through the moulding formwork set.

The gap between linearly aligned concrete wall panels provides for FIG. (18) for central to central alignment/adjustment and also serves the purpose of expansion join for structural requirement. It will be understood that the gap can also be used as the cast in-situ column by introducing steel bars and concrete into a core formed by two adjacently placed concrete wall panels.

What is claimed is:

1. A building made substantially of pre-cast concrete walls, pre-cast concrete floors and columns, said pre-cast concrete walls having cornices at upper edge formations and having door or window openings with optional cornice formations at peripheral edge of the openings, said cornice formations casted simultaneously in the same mold, said walls having longitudinal recess at terminal edges wherein a bore of sufficient size capable of receiving reinforcement elements and concrete and which is non water seepage is formed by two adjacent longitudinal recesses and which bore is a stiffener column when concrete and reinforcement elements are introduced, said pre-cast concrete floors having a concave shape recess at one side and, said concrete columns having one of 'L', 'T' or 'cross' shaped in cross-section, all columns having a bore therethrough to receive concrete and reinforcement elements and having cornice formations at upper edge formations casted simultaneously in the same mold wherein the said walls, columns and floors are interlinked to form an enclosure.

2. A building as claimed in claim 1 wherein the pre-cast concrete walls are spaced apart in parallel alignment and which have at least one longitudinal bore therethrough to receive concrete and reinforcement elements and wherein upper surface of the said wall and upper surfaces of at least two columns on both sides of the concrete wall form a base surface and together with edge surfaces of the pre-cast concrete floors laid across the two parallel spaced apart concrete walls and the columns form a trough of sufficient size into which trough concrete and reinforcement elements are introduced to form a beam extending across the columns and wherein the said walls and columns form an enclosure.

3. A building as claimed in claim 1 wherein the upper edge formations of the pre-cast concrete wall are broader than a body of the wall and capable of receiving pre-cast floor panels to form a trough of sufficient size to receive reinforcement elements and concrete to form a beam across two columns which are placed on both sides of the pre-cast concrete wall.

4. A building as claimed in claim 2 wherein the beams and the 'L', 'T', and 'cross-shaped' columns are cast in situ to form a frame structure of a multi-story building.

5. A building as claimed in claim 1 wherein one or more of the said wall is integrally cast with one or more limbs of the 'L', 'T', or 'cross-shaped' columns.

6. A building as claimed in claim 1 wherein pre-cast concrete wall includes surface indentations, or ribs on at least one side surface, said indentations or ribs casted simultaneously in the same mold.

7. A building comprising:

walls comprising upstanding pre-cast concrete wall panels, each wall panel having a horizontally extending upper edge formation and opposed vertically extending side edge formations, at least some of the wall panels being positioned adjacent one another such that the side edge formation of one panel faces the side edge formation of an adjacent panel, and at least some of the wall panels defining window openings and at least some of the wall panels defining door openings;

floors formed from a plurality of pre-cast concrete floor panels, each pre-cast concrete floor panel defining opposed major faces and at least one recess extending across a major portion of at least one of the faces;

a plurality of upstanding corner columns positioned between adjacent wall panels to form corners of the walls of the building between the wall panels, at least one of the corner columns having a cross-sectional "L" shaped profile, or at least one of the corner columns having a cross-sectional "T" shaped profile, or at least one of the corner columns having a cross-sectional "cross" shaped profile, the on each corner column defining a horizontally extending upper edge formation and at least two opposed vertically extending side edge formations;

connecting columns extending between the side edge formations of adjacent panels and between the side edge formations of adjacent panels and corner columns, each connecting column having been formed by casting concrete into a cavity extending vertically between the side edge formations of adjacent panels and adjacent wall panels and corner columns, the cavity having been defined by a vertically extending recess defined by the side edge formation of one panel and a vertically extending recess defined by the side edge formation of an adjacent panel or corner column; and a cornice formation extending horizontally along an upper edge of the walls, the cornice formation being defined at least partially by cornice formations extending along the upper edge formation of each wall panel and each corner column, the cornice formation of each wall panel and corner column having been formed by casting the cornice formation in a mold together with the rest of the wall panel or corner column respectively.

8. The building of claim 7, which further comprises a load bearing beam extending along at least part of an upper edge defined by the wall panels, corner columns and connecting columns.

9. The building of claim 8, wherein the load bearing beam extends between two adjacent floor panels and along a generally horizontally extending surface defined by the at least part of the upper edge.

10. The building of claim 9, wherein side edges of at least some of the floor panels extend along an edge portion of said horizontally extending surface and side edges of at least some other floor panels extend along an opposed edge portion of said horizontally extending surface, the load bearing beam having been formed by casting concrete into a trough-like arrangement defined between the side edges of the floor panels and said horizontally extending surface.

11. The building of claim 10, wherein at least some of the wall panels have anchor formations extending from their upper edges so as to protrude into the trough-like arrangement, the anchor formations anchoring said load bearing beam relative to the wall panels.

12. The building of claim 11, wherein at least some of the floor panels have anchor formations extending from their side edges so as to protrude into the trough-like arrangement, the anchor formations anchoring said load bearing beam relative to the floor panels.

13. A method of constructing a building with a plurality of pre-cast concrete components comprising of pre-cast concrete walls having cornices at upper edge formations at peripheral edge of the openings, said walls having longitudinal recess at terminal edges wherein a bore of sufficient size capable of receiving reinforcement elements and concrete and which is non-water seepage is formed by two adjacent longitudinal recesses, pre-cast concrete floors having a concave shaped recess at one side and pre-cast concrete columns having one of 'L', 'T' or 'cross-shaped' in cross-section, all columns having a bore therethrough, and having a recess at terminal edges wherein a bore of sufficient size capable of receiving reinforcement elements and concrete and which is non-water seepage is formed by two adjacent longitudinal recesses and having cornice formations at upper edge formations, wherein the method comprises of:

arranging a plurality of the pre-cast concrete walls with at least one or more 'L', 'T', or 'cross-shaped' in cross section columns in an upright manner to form an enclosure, introducing reinforcement elements and concrete into the bores formed by the recesses in the walls and columns to form a stiffener columns and, placing at least one pre-cast concrete floor across two parallel spaced apart concrete walls and columns, introducing reinforcement elements and concrete into a trough formed by the upper surface of the said wall and upper surfaces of at least two columns on both sides of the concrete wall and the edge surfaces of the pre-cast concrete floors to form a longitudinal beams.

14. A method of constructing a building as claimed in claim 13 wherein a tubular gasket is introduced into the bores before the introduction of concrete into the bores.

* * * * *